US008338067B2

(12) United States Patent
Yoshino et al.

(10) Patent No.: US 8,338,067 B2
(45) Date of Patent: Dec. 25, 2012

(54) ELECTROSTATIC IMAGE DEVELOPER, DEVELOPER CARTRIDGE, PROCESS CARTRIDGE, IMAGE FORMING APPARATUS AND IMAGE FORMING METHOD

(75) Inventors: Susumu Yoshino, Kanagawa (JP); Hideo Maehata, Kanagawa (JP); Satoshi Hiraoka, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 327 days.

(21) Appl. No.: 12/732,740

(22) Filed: Mar. 26, 2010

(65) Prior Publication Data

US 2011/0020746 A1 Jan. 27, 2011

(30) Foreign Application Priority Data

Jul. 23, 2009 (JP) ..... 2009-171788

(51) Int. Cl.
*G03G 9/00* (2006.01)

(52) U.S. Cl. ..... 430/111.4; 430/111.1; 430/111.31; 430/111.32

(58) Field of Classification Search ..... 430/111.1, 430/111.31, 111.32, 111.4
See application file for complete search history.

(56) References Cited

U.S. PATENT DOCUMENTS

| | | | | |
|---|---|---|---|---|
| 6,100,001 | A | 8/2000 | Someda et al. | |
| 7,014,971 | B2 * | 3/2006 | Skorokhod et al. | 430/111.32 |
| 2002/0021906 | A1 | 2/2002 | Yoshizaki et al. | |
| 2007/0172748 | A1 * | 7/2007 | Inoue et al. | 430/45.56 |

FOREIGN PATENT DOCUMENTS

| | | |
|---|---|---|
| JP | A-8-95308 | 4/1996 |
| JP | A-11-24323 | 1/1999 |
| JP | A-2002-287431 | 10/2002 |
| JP | A-2005-215397 | 8/2005 |
| JP | A-2006-39445 | 2/2006 |
| JP | A-2008-209489 | 9/2008 |
| JP | A-2008-268489 | 11/2008 |
| JP | A-2008-293054 | 12/2008 |

* cited by examiner

*Primary Examiner* — Stewart Fraser
(74) *Attorney, Agent, or Firm* — Oliff & Berridge, PLC

(57) ABSTRACT

An electrostatic image developer is provided, the electrostatic image developer including: a carrier for an electrostatic image developer, the carrier including a core particle which has a plurality of projections on a surface of the core particle; and electrostatic image developing toners, wherein the electrostatic image developer satisfies following relationships of formulae (1) and (2):

$$0.5t<H \quad (1)$$

$$2^{1/2}t<L<5t \quad (2)$$

wherein t represents a volume average particle diameter (μm) of the toners; H represents an average height difference (μm) in the recesses and projections of the core particle; and L represents an average distance (μm) between the projections.

13 Claims, 3 Drawing Sheets

ELECTROSTATIC IMAGE DEVELOPER, DEVELOPER CARTRIDGE, PROCESS CARTRIDGE, IMAGE FORMING APPARATUS AND IMAGE FORMING METHOD

CROSS-REFERENCE TO RELATED APPLICATIONS

This application is based on and claims priority under 35 U.S.C. 119 from Japanese Patent Application No. 2009-171788 filed Jul. 23, 2009.

BACKGROUND

1. Technical Field

The present invention relates to an electrostatic image developer, a developer cartridge, a process cartridge, an image forming apparatus and an image forming method.

2. Related Art

A method for visualizing an image information through an electrostatic latent image (electrostatic image), such as electrophotography, is currently used in various fields. In the electrophotography, an electrostatic latent image formed on a photoreceptor by charging and exposure steps is developed with an electrostatic image developer (hereinafter sometimes referred to as a "developer" for simplicity) containing an electrostatic image developing toner (hereinafter sometimes referred to as a "toner" for simplicity), and is visualized through a transfer step and a fixing step. A developer used in development includes a two-component developer containing a toner and a carrier for an electrostatic image developer (hereinafter sometimes referred to as a "carrier" for simplicity), and a one-component developer using a toner alone such as a magnetic toner. In the two-component developer, a carrier shares functions of stirring, transportation, charging and the like of a developer, and thus is functionally separated. As a result, the two-component developer has the characteristics of good controllability, and is widely used at present.

In such a two-component developer, investigations of reducing a particle diameter are made in a toner to obtain a full color image having high image quality and high definition. Furthermore, investigations are made in a carrier to control the carrier to a range showing semiconductivity from the standpoint of electric resistance.

Reduction of a particle size of a toner is initially advantageous to high image quality. However, when external additives on the surface of a toner having a small diameter are buried in the toner, transfer efficiency is remarkably decreased, easily causing deterioration of image quality. Furthermore, investigations of fixing a toner at low temperature are made to achieve powder saving. However, a toner which is easily fixed at low temperature tends to decrease its hardness, and external additives are susceptible to be buried by stirring in a developing device. For the stabilization of developability, transferability and cleanability of a toner having a small diameter, a toner which fixes at low temperature and a toner which fixes under pressure, a carrier is required to have low stress to a toner.

In general, a carrier is preferably appropriately amorphous to stably obtain developer transportability by a developer supporter. When the carrier is too spherical, carrier particles themselves induce slip, resulting in deterioration of transportability. On the other hand, when the carrier is too amorphous, such a shape adversely affects chargeability imparting function and charging sustainability.

Further, in general a carrier preferably has low specific gravity to reduce stress imparted to a toner. In this case, various properties described above required in a carrier must be maintained. To achieve this, many magnetic substance dispersion type carriers are recently proposed. The magnetic substance dispersion type carrier permits to decrease specific gravity of carrier particles while maintaining magnetic properties by dispersing a magnetic powder having strong magnetic properties in a resin having small specific gravity. However, the carrier mentioned above shows certain effects in transportability of a toner and reduction in stress to a toner, but the effects are low.

SUMMARY

According to an aspect of the present invention, there is provided an electrostatic image developer, including:

a carrier for an electrostatic image developer, the carrier including a core particle which has plural projections on a surface of the core particle; and electrostatic image developing toners, wherein the electrostatic image developer satisfies following relationships of formulae (1) and (2):

$$0.5t<H \quad (1)$$

$$2^{1/2}t<L<5t \quad (2)$$

wherein t represents a volume average particle diameter (μm) of the toners;

H represents an average height difference (μm) in the recesses and projections of the core particle; and L represents an average distance (μm) between the projections.

BRIEF DESCRIPTION OF THE DRAWINGS

Exemplary embodiment of the present invention will be described in detail based on the following figures, wherein.

DETAILED DESCRIPTION

I. Electrostatic Image Developer

The electrostatic image developer according to the present exemplary embodiment includes a carrier for an electrostatic image developer, including a core particle of the carrier, the core particle having plural projections on the surface thereof, and an electrostatic image developing toners, and is satisfied with the relationships of the following formula (1) and formula (2):

$$0.5t<H \quad (1)$$

$$2^{1/2}t<L<5t \quad (2)$$

wherein t represents a volume average particle diameter (μm) of the toners, H represents an average height difference (μm) in the recesses and projections, and L represents an average distance (μm) between the projections.

The exemplary embodiment of the present invention is described below. The present exemplary embodiment is one exemplary embodiment for carrying out the present invention, and the invention is not limited to the present exemplary embodiment. Unless otherwise indicated, the expression "from A to B" showing a numerical range is synonymous with "A or more and B or less", and includes the values of both extremities of the range.

1. Carrier for Electrostatic Image Developer

In general, the carrier preferably has small specific gravity to reduce stress applied to a toner. In this case, the carrier desirably maintains transportability of a toner, charge imparting properties to a toner and electric resistance of a developer in appropriate ranges to stably obtain an image having high image quality. In view of this, the present inventors have made intensive investigations to obtain an electrostatic image developer including a carrier having a shape useful to toner transportability and other various properties. As a result, it has been found that a carrier for an electrostatic image developer, having a shape that a core particle of the carrier has plural projections on the surface thereof achieves low stress to a developer, excellent toner transportability, and electric resistance stability of a developer.

Figure 1:
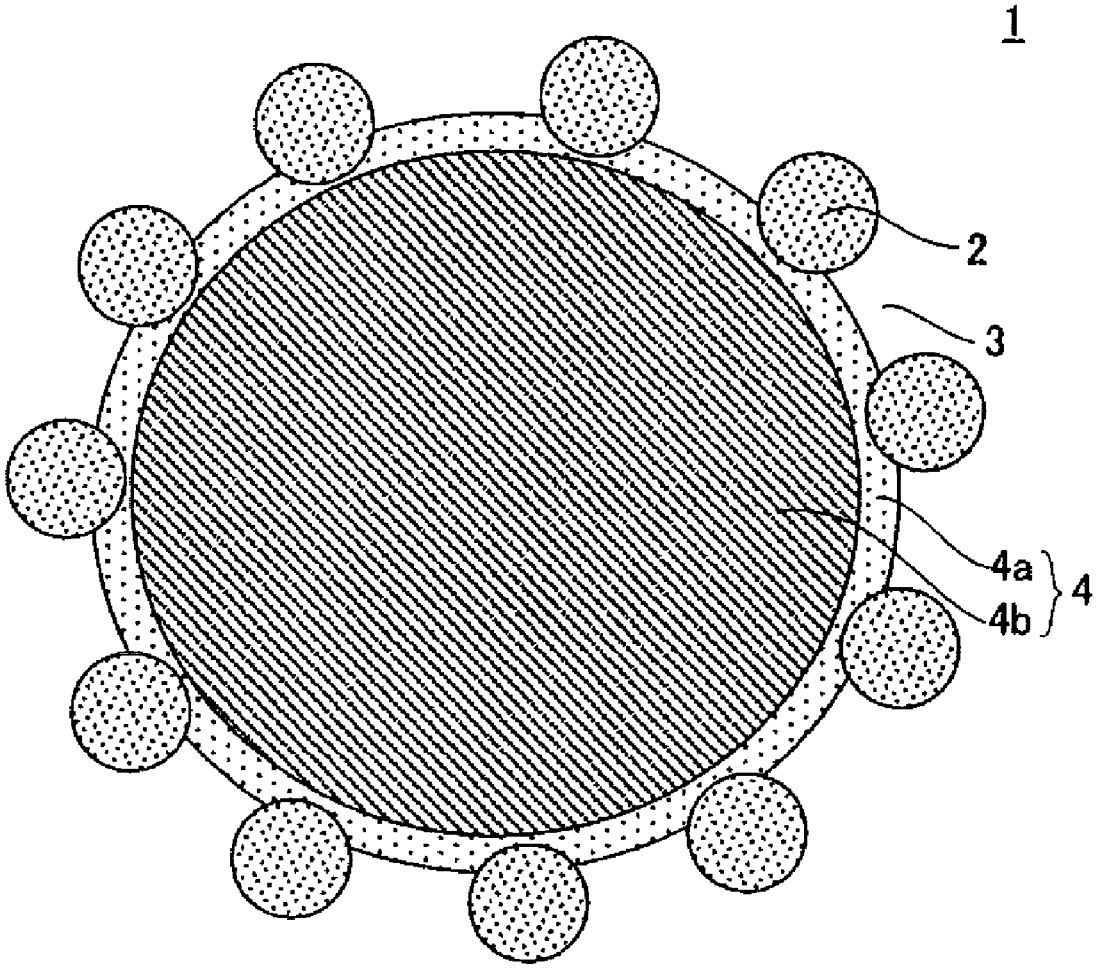
FIG. 1 is a schematic cross-sectional view of a carrier contained in the electrostatic image developer according to the present exemplary embodiment.

FIG. 1 is a schematic cross-sectional view of a carrier contained in the electrostatic image developer according to the present exemplary embodiment. A carrier 1 includes a carrier core particle 4 including a coating resin layer 4*a* and a carrier core material 4*b*, the carrier core particle 4 having plural projections 2 and recesses 3 formed on the surface thereof, thus the carrier having a recess-projection shape, as shown in FIG. 1. This shape increases a surface area per one carrier, and increases charge imparting ability to a toner. A toner (not shown) is liable to be present on the carrier recesses 3, and therefore suppresses excessive mechanical force from being applied to a toner in collision between a carrier and a carrier, and collision between a carrier and an inner wall of a developing device or a member for controlling a developer. As a result, stress to a toner is reduced. Reduction of stress suppresses not only a toner from being ruptured but an external additive on the toner surface from being embedded in the toner. As a result, properties such as developability, transferability and cleanability do not deteriorate, and toner properties in the initial state are maintained. Furthermore, a toner does not interfere with contact between a carrier and a carrier in the formation of magnetic brush by a developer formed on a developer supporter. Therefore, the magnetic brush is suppressed from excessive rise of electric resistance even though toner concentration is increased. As a result, development field is stabilized, and an image having high quality is stably obtained particularly in a color image.

It is effective to control the size and the distance of recesses and projections so as to be fallen within appropriate ranges so that a toner is present on the recesses of a carrier and does not receive excessive stress. The carrier having such recesses and projections is very effective to not only a toner of heat fixation system but a toner of pressure fixation system. The toner of pressure fixation system is a toner which fixes by pressure. Therefore, the toner is weak to stress by pressure and is easy to cause deformation and rupture.

In the present exemplary embodiment, the average height difference H (μm) in recesses and projections on the surface of a carrier is larger than 0.5 times a volume average particle diameter t of toners, and an average distance L between projections is larger than $2^{1/2}$ times and smaller than 5 times, a volume average particle diameter t of toners. Specifically, the average height difference H and the average distance L have the relationships satisfied with the following formula (1) and formula (2), respectively:

$$0.5t<H \quad (1)$$

$$2^{1/2}t<L<5t \quad (2)$$

wherein t represents a volume average particle diameter (μm) of toners, H represents an average height difference in recesses and projections on the surface of a carrier, and L represents an average distance (μm) between the projections on the surface of a carrier.

In the case that the average height difference and the average distance are not satisfied with the formula (1) and the formula (2), a toner receives excessive stress when the toner is present in spaces between recesses of a carrier in a state that carrier projection and carrier projection contact each other.

More specifically, in the case that H in the formula (1) is 0.5t or less, depth of the carrier recess is not sufficient, and this cannot suppress stress of the carrier recess to a toner, resulting in deterioration of stability of image quality. H is more preferably from 0.55t to 1.0t. When H is fallen within the above numerical range, stress of the carrier recess to a toner may be suppressed and stability of image quality is maintained, which is preferred.

The value of the average height difference H in the recesses and projections is preferably from 1.5 or about 1.5 to 3.5 or about 3.5 μm, and more preferably from 2.0 to 3.0 μm.

In the case that L in the formula (2) is $2^{1/2}$t or less, a toner does not sufficiently incorporate into carrier recesses, suppression of stress to a toner is poor. On the other hand, in the case that L in the formula (2) is 5t or more, distance between carrier recesses is too large, and this cannot suppress stress to a toner, resulting in deterioration of stability of image quality. L is more preferably from 1.5t to 4.5t. When L is fallen within the above numerical range, stress of the carrier recess to a toner may be suppressed and stability of image quality is maintained, which is preferred.

The value of the average distance L between the projections is preferably from 5.0 or about 5.0 to 15.0 or about 15.0 μm, and more preferably from 6.0 to 13.0 μm.

H (average height difference (μm) in recesses and projections, and L (average distance (μm) between projections) are measured with, for example, observation by electron microscope. It is most easy to directly read off the height difference from an electron microphotograph.

The height difference in the recesses and projections used herein corresponds to difference in a radius between a sphere circumscribing with a carrier and a sphere circumscribing with the bottom of the recess. The height difference in recesses and projections means an average of the height differences obtained by observing 10 carriers having a volume average particle diameter fallen within the range of average particle diameter ±10%.

The average distance between the projections used herein means an average of distances between a tip of the projection and a tip of other nearest projection, obtained by observing 10 carriers having a volume average particle diameter fallen within the range of average particle diameter ±10%.

The carrier has a shape factor SF1 of preferably from more than 145 to 170 or about 170, and more preferably from more than 145 to 160. When the shape factor SF1 of a carrier exceeds 145, the shape of a carrier is appropriately amorphous, and charge imparting ability to a toner is sufficient. When SF1 is 170 or less, fluidity of a developer is appropriate.

The shape factor SF1 is obtained as follows. Optical microscope image of a carrier spread on a slide glass is loaded on Luzex image analyzer through a video camera. Maximum length (ML) and projected area (A) of 100 or more carriers are measured, and the average value is calculated based on the following formula and is used as SF1.

$$SF1=\{(ML)^2/A\}\times(\pi/4)\times100$$

The carrier has volume average grain size distribution index GSDv of 1.25 or less, and preferably from 1.20 to 1.23. When the GSDv is fallen within the numerical range, basic performances of a carrier, such as adhesion of a carrier to a photoreceptor and poor charging, is suppressed from decreasing.

The carrier has volume average particle diameter $D_{50v}$ of preferably from 15 μm to 50 μm, more preferably from 25 μm to 45 μm, and further from 30 μm to 40 μm. When the volume average particle diameter $D_{50v}$ of the carrier is 15 μm or more, the carrier is not developed together with a toner. When the volume average particle diameter $D_{50v}$ of the carrier is 50 μm or less, charge is well imparted to a toner having a small diameter.

It is preferred in the present exemplary embodiment that the number of toners adhered to the projections is smaller than the number of toners adhered to the surface of a core particle, that is, recesses, of the carrier. Adhesion of toners to the recesses of a carrier is achieved by that toner charge imparting force of the projections is relatively smaller than that of the recesses by changing material constitution in the relationship between the projections and the recesses of a carrier. Specifically, the adhesion is achieved by electrostatically adhering and existing toners to the recesses. A method for changing material constitution includes a method of providing difference in the content of a conductive material, a method of using different resins such that charge imparting force differs, and a method of providing difference in the content of a charge regulator.

The method of providing difference in the content of a conductive material is preferred in the present exemplary embodiment. The exemplary embodiment that the projections contain a conductive material is more preferred. When the projections contain a conductive material, electric resistance at the time of magnetic brush formation is controlled to an appropriate range, and additionally, change in electric resistance to the change of toner concentration is suppressed.

Adhesion of a toner to a carrier is desirably that a developer in a state that toner concentration in a developing machine is from 4 to 5% by weight when a carrier is 100% by weight is driven in blank run for 2 minutes, the developer sampled from the surface of a developer holder is observed with electron micrograph, projections of a carrier to which a toner is not adhered are confirmed, and the proportion of the number of the toner-non-adhered projections to the total number of the projections of a carrier exceeds 70%. Where the proportion is less than 70%, reduction of stress to a toner is not sufficient.

In the present exemplary embodiment, magnetic susceptibility σ of a carrier is measured with BH tracer method using VSM (vibration sample method) measuring instrument in magnetic field of 1 kOe, and the magnetic susceptibility value σ 1,000 is a range of from 50 or about 50 $Am^2/kg$ (emu/g) to 90 or about 90 $Am^2/kg$ (emu/g), and preferably from 55 $Am^2/kg$ (emu/g) to 70 $Am^2/kg$ (emu/g). When the σ 1,000 is 50 $Am^2/kg$ (emu/g) or more, magnetic adsorption power to a development roll is sufficient, and a carrier does not induce image defect due to adhesion of the carrier to a photoreceptor. When the σ 1,000 is 90 $Am^2/kg$ (emu/g) or less, magnetic brush has appropriate hardness, and the magnetic brush does not strongly rub a photoreceptor, and does not scratch the surface thereof.

A carrier has electric resistance in a range of from $1\times10^5$ Ω·cm to $1\times10^{14}$ Ω·cm, and preferably from $1\times10^9$ Ω·cm to $1\times10^{12}$ Ω·cm, when measurement electric field is electric field of 10,000 V/cm. When the electric resistance of a carrier is $1\times10^5$ Ω·cm or more, charges are difficult to move on the surface of a carrier, and as a result, image defect such as brush mark may be suppressed. Furthermore, chargeability may be suppressed from decreasing even though printing operation is not conducted for a while and is left unconducted. As a result, background contamination is not generated in first one print. When the electric resistance of a carrier is $1\times10^{14}$ Ω·cm or less, good solid image is obtained, and toner charge is not excessively increased even though continuous printing is repeated several times. As a result, image density may be suppressed from changing.

Dynamic electric resistance when measured by forming a carrier in a form of magnetic brush is a range of preferably from about 1×10 Ω·cm to about $1\times10^9$ Ω·cm, and more preferably from $1\times10^3$ Ω·cm to $1\times10^8$ Ω·cm, under electric field of $10^4$ V/cm. When the dynamic electric resistance is 1×10 Ω·cm or more, image defect such as brush mark may be suppressed. When the dynamic electric resistance is $1\times10^8$ Ω·cm or less, good solid image is obtained. The electric field of $10^4$ V/cm is close to development electric field in actual equipment, and the dynamic electric field is a value under the electric field.

From the above, the dynamic electric resistance when a carrier and a toner are mixed is appropriately a range of from $1\times10^5$ Ω·cm to $1\times10^9$ Ω·cm. When the dynamic electric resistance is $1\times10^5$ Ω·cm or more, background contamination due to decrease in toner chargeability after printing and then leaving may be prevented from generating, and decrease in resolution by widening of line image due to overdevelopment may be suppressed. When the dynamic electric resistance is $1\times10^9$ Ω·cm or less, developability at the edge of a solid image may be suppressed from decreasing. As a result, high quality image is obtained.

The dynamic electric resistance of a carrier is obtained as follows. About 30 $cm^3$ of a carrier is placed on a development roll (magnetic field on a sleeve surface of the development roll generates 1 kOe) to form magnetic brush. A flat plate electrode having an area of 3 $cm^2$ is placed so as to face the development roll with a distance of 2.5 mm. Voltage is applied between the development roll and the flat plate electrode while rotating the development roll at a rotation rate of 120 rpm, and electric current flown at the time is measured. The dynamic electric resistance is obtained from current-voltage characteristics obtained using the expression of Ohm's law. It is well known that the relationship of $\ln(I/V) \propto V\times1/2$ generally exists between the applied voltage V and the electric current I at the time.

In the case that the dynamic electric resistance is considerably low as in the carrier used in the present exemplary embodiment, large electric current flows in high electric field of $10^3$ V/cm or more, and the dynamic electric resistance cannot be measured in some cases. In such a case, measurement is made on at three points or more in low electric field, and the values measured are extrapolated up to the electric field of $10^4$ V/cm by the method of least squares using the above relational expression. Thus, the dynamic electric resistance is obtained.

2. Production Method of Carrier

In the present exemplary embodiment, a carrier produced by the following production method is preferred. The production method includes a step of preparing a core particle of a carrier (preparation step of carrier core particle), a step of preparing particles for forming projections (preparation step of particles for forming of projections), an adhesion step of mixing a dispersion of the core particle of the carrier and a dispersion of particles for forming projections to form a particle including the core particle of one carrier and plural particles for forming of projections adhered on the surface thereof, and a fusing step of heating the core particle of the carrier and particles for forming projections adhered on the surface thereof, thereby fusing those.

In the present exemplary embodiment, the particles for forming projections are preferably conductive particle-dispersed particles including a resin and conductive particles dispersed therein. A production method of the carrier is described below by reference to the case that the particles for forming projections are conductive particle-dispersed particles as one example.

Preparation Step of Carrier Core Particle

In the present exemplary embodiment, the production method of the carrier is preferably a production method including a step of preparing a core particle of the carrier. The core particle of the carrier preferably includes a carrier core material and at least one layer of a coating resin layer which covers the carrier core material.

Material of the carrier core material used in the present exemplary embodiment is not particularly limited. Examples of the material include magnetic metals such as iron, steel, nickel and cobalt, magnetic oxides such as ferrite and magnetite, and glass beads. Of those, the magnetic materials are preferably used when a magnetic brush method is employed in development.

The carrier core material preferably uses a magnetic substance dispersion type carrier core including a resin and a magnetic powder dispersed therein. The spherical core has small specific gravity, and therefore has the advantage that stress to a toner and a carrier may be suppressed. A combination of the magnetic substance dispersion type core and the coating resin is effective in obtaining charging sustainability and environmental stability. Examples of a resin used in the magnetic powder dispersion type carrier core include crosslinking resins such as phenolic resin and melamine resin, and thermoplastic resins such as polyethylene and polymethyl methacrylate. The carrier may contain additives such as charge-controlling agent.

The magnetic substance dispersion type core is preferably prepared by a wet process from the standpoint of easy of controlling surface shape. The wet process includes an emulsion polymerization aggregation method including mixing a resin particle dispersion obtained by emulsion polymerizing polymerizable monomers and a dispersion of magnetic particles to form aggregated particles, and fusing and associating the particles by heating, thereby obtaining magnetic substance dispersion type cores; a suspension polymerization method including suspending polymerizable monomers and magnetic particles in an aqueous solvent, and polymerizing those, thereby obtaining carrier core material particles; and a dissolution suspension method including suspending a binder resin and magnetic substance particles in an aqueous solvent, followed by granulation. Of those methods, the suspension polymerization method is preferred in the present exemplary embodiment.

The carrier core material has a volume average particle diameter in a range of preferably from 10 to 45 μm, more preferably from 25 to 45 μm. When the volume average particle diameter is fallen within the numerical range, a carrier is not developed together with a toner, and charges are sufficiently imparted to a toner, which is preferred.

The carrier core material has true specific gravity of from about 4 to 6 g/cm$^3$. When the true specific gravity is fallen within the numerical range, a developer has good fluidity, and stress to a toner may be reduced, which is preferred.

In the present exemplary embodiment, the core particle of the carrier is preferably a particle including a carrier core material and at least one layer of a coating resin layer formed on the surface thereof, and is more preferably a particle including a magnetic substance dispersion type carrier core and at least one layer of a coating resin layer formed on the surface thereof.

The coating resin for coating the surface of the carrier core material may be thermoplastic resins and thermosetting resins, and may use the conventional resins.

Examples of the thermoplastic resin used include polyethylene, polypropylene, polystyrene, polyacrylonitrile, polyvinyl acetate, polyvinyl alcohol, polyvinyl butyral, polyvinyl chloride, polyvinyl carbazole, polyvinyl ether, polyvinyl ketone, vinyl chloride-vinyl acetate copolymer and styrene-acrylic acid copolymer.

Examples of the thermosetting resin used include polyurethane, amino resin, melamine resin, benzoguanamine resin, urea resin and amide resin. However, the thermosetting resin is not limited to those resins.

A conductive material may be contained in the coating resin for the purpose of, for example, adjusting electric resistance of a carrier. Examples of the conductive material used include metals such as gold, silver and copper; titanium oxide, zinc oxide, barium sulfate, aluminum borate, potassium titanate, tin oxide and carbon black. Examples of the conductive material used further include resins called conductive resins and semi-conductive resins. The conductive material is not limited to those materials.

In the present exemplary embodiment, the coating resin layer is not particularly limited, and is formed by the conventional film forming methods. The coating resin layer is formed by, for example, a method including applying a resin solution to a carrier core material; a method including applying a solution of a monomer, an oligomer or a polymer, constituting a resin, to a carrier core material, and increasing its molecular weight by dry solidification or an appropriate chemical reaction; and a method including intentionally precipitating and curing a part of a film forming material in forming a film by precipitation, lamination or the like of a chemical film to the surface of a carrier core material. The formation method of the coating resin layer further includes a dipping method including introducing a resin and other materials into a resin-soluble solvent to obtain a raw material solution for forming a coating resin layer, and dipping a powder of a carrier ore material in the raw material solution for forming a coating resin layer; a spraying method including spraying a solution for forming a coating resin layer to the surface of a carrier core material; a fluidized bed method including spraying a solution for forming a coating resin layer to the surface of a carrier core material in a state of floating the carrier core material by flow air; and a kneader coater method including mixing a carrier core material and a solution for forming a coating resin layer in a kneader coater, and the removing a solvent.

Preparation Step of Particles for Forming Projections

In the present exemplary embodiment, the production method of the carrier is preferably a production method including a step of preparing particles for forming projections. In the present exemplary embodiment, the particles for forming projections are preferably conductive particle-dispersed particles including a resin and conductive particles dispersed therein.

The conductive particle-dispersed particles may be prepared by a dry process including kneading conductive particles and a resin with a kneader or the like, followed by pulverization and classification. However, a wet process is suitable to obtain particles having a small particle diameter of 5 μm or less in narrow particle size distribution.

Examples of the wet process include an emulsion polymerization aggregation method including mixing a resin particle dispersion obtained by emulsion polymerizing a polymerizable monomer of a binder resin, a conductive particle dispersion, and if necessary, a charger controlling agent to form aggregated particles, and fusing and associating the aggregated particles by heating to obtain conductive particle-dispersed particles; a suspension polymerization method including suspending a polymerizable monomer for obtaining a binder resin, conductive particles, and if necessary, a solution of a charge controlling agent in an aqueous solvent, and polymerizing those to obtain conductive particle-dispersed particles; and a dissolution suspension method including suspending a binder resin, conductive particles, and if necessary, a charge controlling agent in an aqueous solvent to granulate conductive particle-dispersed particles. Of those methods, an emulsion polymerization aggregation method is most preferred.

Examples of the conductive material of the conductive particle-dispersed particles include metals such as gold, silver and copper; titanium oxide, zinc oxide, barium sulfate, aluminum borate, potassium titanate, tin oxide and carbon black. Examples of the conductive material further include resins called conductive resins and semiconductive resins. However, the conductive material is not limited to those materials.

The resin of the conductive particle-dispersed particle may be thermoplastic resins and thermosetting resins, and may use the conventional resins.

Examples of the thermoplastic resin used include polyethylene, polypropylene, polystyrene, polyacrylonitrile, polyvinyl acetate, polyvinyl alcohol, polyvinyl butyral, polyvinyl chloride, polyvinyl carbazole, polyvinyl ether, polyvinyl ketone, vinyl chloride-vinyl acetate copolymer and styrene-acrylic acid copolymer.

Examples of the thermosetting resin used include polyurethane, amino resin, melamine resin, benzoguanamine resin, urea resin and amide resin. However, the thermosetting resin is not limited to those resins.

The ratio of the resin to the conductive particle in the conductive particle-dispersed particle may be, for example, a range of from 1:0.05 to 1:0.5 in weight ratio. When the weight ratio is 1:0.05 or more, electric resistance of a carrier is appropriate, and a clear color image is obtained. When the weight ratio is 1:0.5 or less, the amount of the conductive particles is appropriate, and the conductive particle-dispersed particle has excellent mechanical strength.

Adhesion Step

In the present exemplary embodiment, the production method of the carrier is preferably a production method including an adhesion step including mixing the dispersion of the carrier core particles and the dispersion of the particles for forming projections to form particles including one carrier core particle and the plural particles for forming projections adhered on the surface of the carrier core particle.

In preparing the carrier, at least the dispersion of the carrier core particles, the dispersion of the conductive particle-dispersed particles (dispersion of particles for forming projections), and if necessary, a cationic surfactant, an anionic surfactant and an aggregating agent are provided, and those are mixed to form particles including one carrier core particle and the plural particles for forming projections adhered on the surface of the carrier core particle.

To obtain particles including one carrier core particle and the plural particles for forming projections adhered on the surface of the carrier core particle, aggregates are preferably formed such that the carrier core particle and the conductive particle-dispersed particles are made to have charges of mutually opposite polarity in water, and plural conductive particle-dispersed particles are selectively and electrostatically adhered to one carrier core particle. Furthermore, the conductive particle-dispersed particles are preferably adhered to the surface of the carrier core particle with a specific distance without contacting the conductive particle-dispersed particles each other by that the conductive particle-dispersed particles having charges of the same polarity repel each other.

Therefore, in the present exemplary embodiment, the production method of the carrier is preferably a production step including the adhesion step of mixing the dispersion of the carrier core particles charged positively (or negatively) and the dispersion of the particles for forming projections charged negatively (or positively) opposite the carrier core particles, and forming particles including one carrier core particle and plural particles for forming projections adhered to the surface of the carrier core particle.

Electrostatic polarity of particles in water is controlled positively or negatively by the constitution of particle. Alternatively, positive or negative polarity is controlled by adding a surfactant. In general, particles are positively charged by adding a cationic surfactant, and particles are negatively charged by adding an anionic surfactant.

Examples of the anionic surfactant include sulfuric acid ester salt type, sulfonic acid salt type, phosphoric acid ester type, and soap type anionic surfactants. Examples of the cationic surfactant include amine salt type and quaternary ammonium salt type cationic surfactants.

The mixing ratio of the carrier core particles to the conductive particle-dispersed particles having smaller volume average particle diameter is preferably a range of from 1:0.05 to 1:0.5 in weight ratio. When the weight ratio is 1:0.05 or more, the number of projections of a carrier is appropriate, and recess-projection state is formed on the carrier. When the weight ratio is 1:0.5 or less, the amount of the conductive particle-dispersed particles is appropriate, and aggregation between the conductive particle-dispersed particles and generation of free particles which do not participate in aggregation are suppressed.

The aggregating agent may use various materials. Metal salts such as poly aluminum chloride and aluminum sulfate are preferably used.

The above materials are provided. Those materials are mixed and stirred, and if necessary, the resulting mixture is subjected to pre-dispersion with a disperser or the like, followed by heating. As the case may be, pH of the mixture is adjusted to 2 to 6. Alternatively, liquid temperature is adjusted such that lower temperature of a glass transition temperature of a resin on the surface of the core particle and a glass transition temperature of a resin of the conductive particle-dispersed particle is the upper limit, thereby proceeding aggregation, and aggregates are formed.

Fusion Step

In the present exemplary embodiment, the production method of the carrier is preferably a production method including a fusion step of heating the carrier core particle and the particles for forming projections adhered on the surface thereof, thereby fusing those.

As necessary, the carrier core particle and the particles for forming projections are heated at a temperature of from 20° C. lower than the glass transition temperature of the resin to 50° C. higher than the glass transition temperature of the resin on the surface of the carrier core particle or the glass transition temperature of the resin of the conductive particle-dispersed particle, thereby preliminarily fusing the carrier core particle and the particles for forming projections adhered on the surface of the carrier core particle. Then, as the case may be, while adjusting pH to from 4 to 9, to suppress further aggregation growth, an appropriate amount of a surfactant is added, and heating is conducted at a temperature of from 30° C. higher than the glass transition temperature of the resin to 50° C. higher than the glass transition temperature of the resin, thereby proceeding fusion between the carrier core particle and the particles for forming projections adhered on the surface of the carrier core particles, followed by adjusting a shape. Thus, carrier particles are obtained. In general, fusion proceeds and height difference in recesses and projection of carrier particles is decreased as heating temperature is high or heating time is long. The above each heating temperature may appropriately be adjusted. If necessary, a coating resin layer may further be formed on the surface of the carrier so long as recesses and projections on the surface thereof do not disappear. The carrier particles thus prepared are then cooled and taken out. Excess surfactant is removed by washing, and dried, thereby completing as a carrier.

According to the production method, shape is controlled by the fusion step, the degree of variant form is increased by mixing plural kinds of aggregates having different volume average particle diameter, thereby widening a shape controlling range, and a carrier having plural projections on the surface thereof is relatively easily prepared. In other words, a carrier having excellent low stress to a toner is obtained by the production method.

Other than the above production method, a method including forming a film on a carrier core material with particles insoluble in a solvent and a resin partially soluble in a solvent, and then removing the soluble part with a solvent is exemplified as a method of producing a carrier for electrostatic image developer, having plural projections on the surface of a core particle of a carrier.

3. Electrostatic Image Developing Toner

The electrostatic image developer according to the present exemplary embodiment includes a carrier for electrostatic image developer including a carrier core particle having plural projections on the surface thereof, and a electrostatic image developing toner (hereinafter referred to as a "toner" for simplicity). Specifically, the electrostatic image developer according to the present exemplary embodiment is a two-component developer including a toner and a carrier.

The toner may be either of a heat fixing toner and a pressure fixing toner, and is not particularly limited. The conventional toner including a binder resin and a colorant as main components, and if necessary, a release agent may be used. The toner may be produced by a dry process such as a kneading pulverization method and a wet process such as an emulsion polymerization aggregation method, a dissolution suspension method and a suspension polymerization method. A toner produced by an emulsion polymerization aggregation method is preferred from that surface exposure of a colorant and a release agent is small and stability of an image is good. Such a toner is that shape of particles is relatively round, a particle size distribution is narrow, toner surface is relatively uniform and has high chargeability, and charging distribution is narrow and good. The toner has narrow particle size distribution, and therefore, generation of fogging is small.

(1) Binder Resin

Examples of the binder resin that may be used in the electrostatic image developing toner for heat fixation in the present exemplary embodiment include polyester resin; ethylene resin such as polyethylene and polypropylene; styrene resin such as polystyrene and poly(α-methylstyrene); (meth) acrylic resin such as polymethyl methacrylate and polyacrylonitrile; polyamide resin, polycarbonate resin, polyether resin, polyester resin, and their copolymer resins.

Examples of a polymerizable monomer used in the polyester resin include the conventional divalent or trivalent or more carboxylic acid and divalent or trivalent or more alcohol, that are polymerizable monomer components as described in, for example, Polymer Data Handbook, basic edition, The Society of Polymer Science, Japan, Baifukan Co., Ltd. As specific examples of those polymerizable monomer components, examples of the divalent carboxylic acid include dibasic acids such as succinic acid, glutaric acid, adipic acid, suberic acid, azelaic acid, sebacic acid, phthalic acid, isophthalic acid, terephthalic acid, naphthalene-2,6-dicarboxylic acid, naphthaliene-2,7-dicarboxylic acid, cyclohexanedicarboxylic acid, malonic acid and mesaconic acid, their anhydrides and their lower alkyl esters; and aliphatic unsaturated dicarboxylic acid such as maleic acid fumaric acid, itaconic acid and citraconic acid. Examples of the trivalent or more carboxylic acid include 1,2,4-benzenetricarboxylic acid, 1,2,5-benzenetricarboxylic acid, 1,2,4-naphthalenetricarboxylic acid, their anhydrides and their lower alkyl esters. Those may be used alone or as mixtures of two or more thereof.

Examples of the dihydric alcohol includes bisphenol A, hydrogenated bisphenol A, ethylene oxide or(and) propylene oxide adduct of bisphenol A, 1,4-cylohexanediol, 1,4-cyclohexanedimethanol, ethylene glycol, diethylene glycol, propylene glycol, dipropylene glycol, 1,3-butanediol, 1,4-butanediol, 1,5-pentanediol, 1,6-hexanediol, 1,9-nonanediol and neopentyl glycol. Examples of the trivalent or more alcohol include glycerin, trimethylolethane, trimethylolpropane and pentaerythritol. Those may be used alone or as mixtures of two or more thereof. According to need, a monovalent acid such as acetic acid and benzoic acid, and a monohydric alcohol such as cyclohexanol and benzyl alcohol, are used for the purpose of, for example, adjusting acid value and hydroxyl value.

The polyester resin may be synthesized in any combination of the above-described polymerizable monomer components using the conventional methods. Ester exchange method, direct polycondensation method and the like are used alone or as a combination thereof.

A homopolymer or a copolymer of an ethylenically unsaturated compound is preferably used as the binder resin of a heat fixing toner. Examples of the binder resin include homopolymers or copolymers of styrenes such as styrene and chlorostyrene; monoolefins such as ethylene, propylene, butylene and isobutylene; ester of α-methylene aliphatic monocarboxylic acid, such as vinyl acetate, vinyl propionate, vinyl benzoate, vinyl butyrate, methyl acrylate, ethyl acrylate, butyl acrylate, dodecyl acrylate, octyl acrylate, phenyl acrylate, methyl methacrylate, ethyl methacrylate, butyl methacrylate and dodecyl methacrylate; vinyl ether such as vinyl methyl ether, vinyl ethyl ether and vinyl butyl ether; vinyl ketone such as vinyl methyl ketone, vinyl hexyl ketone and vinyl isopropenyl ketone. Particularly representative examples of the binder resin include polystyrene, styrene/alkyl acrylate copolymer, styrene/alkyl methacrylate copolymer, styrene/acrylonitrile copolymer, styrene/butadiene copolymer, styrene/maleic anhydride copolymer, polyethylene and polypropylene. Further examples of the binder resin include polyester, polyurethane, epoxy resin, silicone resin, polyamide, modified rosin and paraffin wax.

Baroplastic is used as a binder resin of a pressure fixing toner. The baroplastic has a high Tg resin (resin having high glass transition temperature) and a low Tg resin (resin having low glass transition temperature) having Tg 20° C. or more lower than Tg of the high Tg resin. The baroplastic is a resin including a combination of a high Tg resin and a low Tg resin, and the high Tg resin and the low Tg resin form a microphase separation state. The baroplastic forming the microphase separation state shows plastic behavior to pressure.

The high Tg resin has Tg in a range of preferably from 45 to 120° C., more preferably from 50 to 110° C., and further preferably from 55 to 100° C. When the Tg is fallen with the numerical range, in the case of using the baroplastic as a binder resin of a toner, the toner has excellent storage properties, caking and filming to a photoreceptor are difficult to be generated, and image quality defect is difficult to cause. Furthermore, fixing temperature at the time of fixing (particularly at the time of fixing to a heavy paper) is appropriate, and a paper is suppressed from curling.

The low Tg resin has Tg of 20° C. or more, preferably 30° C. or more, and further preferably 40° C. or more, lower than Tg of the high Tg resin. When the Tg is fallen within the numerical range, in the case of using the baroplastic as a binder resin of a toner, the toner is excellent in pressure plasticization behaviors, particularly fixing temperature and fixing pressure at the time of fixing to a heavy paper are suppressed low, and a paper is suppressed from curling.

The baroplastic of the present exemplary embodiment is preferably satisfied with the relationship shown by the following formula (3):

$$20^\circ\,\mathrm{C.} \leqq \{T(0.5\mathrm{MPa}) - T(30\mathrm{MPa})\}^\circ\,\mathrm{C.} \quad (3)$$

wherein T(0.5 MPa) represents a temperature at which viscosity is $10^4$ Pa·s at flow tester applied pressure of 0.5 MPa, and T(30 MPa) represents a temperature at which viscosity is $10^4$ Pa·s at flow tester applied pressure of 30 MPa.

When the baroplastic is satisfied with the relationship of the formula (3), sufficient plasticization behaviors by applying pressure are obtained.

Examples of the combination of the high Tg resin and the low Tg resin include the following exemplary embodiments.

(A) Block copolymer including a block of high Tg resin and a block of low Tg resin, difference in glass transition temperature between the two blocks being 20° C. or more.

(B) Resin including aggregates of resin particles having a core-shell structure, difference between a glass transition temperature of a resin constituting a core and a glass transition temperature of a resin constituting a shell being 20° C. or more.

(C) Resin mixture having a sea-island structure formed by two resins having difference in glass transition temperature of 20° C. or more.

In the present exemplary embodiment, the block copolymer (A) is preferred.

The total amount of the high Tg resin and the low Tg resin is preferably 60% by weight or more, and more preferably from 80 to 100% by weight, based on the weight of the block copolymer. Further preferable embodiment is that the block copolymer is a block copolymer including a block of the high Tg resin and a block of the low Tg resin.

The ratio between the block of the high Tg resin and the block of the low Tg resin is preferably that the proportion of the block of the high Tg resin is from 25 to 75% by weight when the total weight of the block copolymer is 100% by weight.

An addition polymerization type resin and a polycondensation type resin are preferably used as each block of the block copolymer. Examples of the addition polymerization type resin include a homopolymer or a copolymer of an ethylenically unsaturated compound. Examples of the polycondensation type resin include a homopolymer or a copolymer of polyester. In the present exemplary embodiment, a block copolymer of an addition polymerization type resin is preferred.

Examples of the ethylenically unsaturated compound include styrenes, (meth)acrylic acid esters, ethylenically unsaturated nitriles, ethylenically unsaturated carboxylic acid, vinyl ethers, vinyl ketones and olefins.

The ethylenically unsaturated compound for synthesizing a block of high Tg resin is preferably a polymer derived from styrenes (styrene and/or its derivatives). Examples of the styrenes include styrene, o-methylstyrene, m-methylstyrene, p-methylstyrene, p-methoxystyrene, p-phenylstyrene, p-chlorostyrene, p-ethylstyrene, p-n-butylstyrene, p-tert-butylstyrene, p-n-hexylstyrene, p-n-octylstyrene, p-n-nonylstyrene, p-n-decylstyrene, p-n-dodecylstyrene, 2,4-dimethylstyrene and 3,4-dichlorostyrene. Of those, styrene is preferably used.

The block of the high Tg resin is preferably a noncrystalline polymer and is more preferably a noncrystalline polystyrene.

The ethylenically unsaturated compound for synthesizing a block of the low Tg resin is preferably (meth)acrylic acid esters, more preferably acrylic acid esters, further preferably acrylic acid alkyl esters having from 1 to 8 carbon atoms in the alkyl moiety, and particularly preferably methyl acrylate, butyl acrylate, hexyl acrylate and 2-ethylhexyl acrylate.

The block copolymer of the ethylenically unsaturated compound is preferably synthesized by a living polymerization method such as anionic polymerization, cationic polymerization, radical polymerization and coordination polymerization. Living radical polymerization method is more preferably used from ease of the combination of its monomer.

The block copolymer has a number average molecular weight of preferably from 10,000 to 150,000, more preferably from 20,000 to 100,000, and further preferably from 30,000 to 60,000. When the number average molecular weight is fallen with the above range, sufficient pressure plasticization fluidization behaviors are obtained, which is preferred.

Each block has a number average molecular weight of preferably from 5,000 to 75,000, more preferably from 10,000 to 50,000, and further preferably from 15,000 to 30,000. When the number average molecular weight is fallen within the above range, the toner has good mechanical strength to various stresses in a system, and good balance between fixability under pressure and image density after fixing.

The number average molecular weight is measured by, for example, gel permeation chromatography (HLC-8120GPC, TSK-GEL, GMH column, manufactured by Tosoh Corporation) under the following conditions.

At a temperature of 40° C., a solvent (tetrahydrofuran) is flown at a flow rate of 1.2 ml per minute, a tetrahydrofurna sample solution having a concentration of 0.2 g/20 ml is poured as a sample weight, and measurement is made. In the measurement of a molecular weight of a sample, measurement conditions included in the range that the molecular weight of the sample is linear in the number of counts to logarithm of a molecular weight of a calibration curve prepared by several kinds of monodisperse polystyrene standard samples are selected.

(2) Colorant

Examples of the colorant include various pigments such as carbon black, Chrome Yellow, Hanza Yellow, Benzidine Yellow, Beslene yellow, Quinoline Yellow, Permanent Orange GTR, Pyrazolone Orange, Pulcan Orange, Watchang Red, Permanent Red, Brilliant Carmin 3B, Brilliant Carmin 6B, Dupont-oil Red, Pyrazolone Red, Rysole Red, Rhodamine B Lake, Lake Red C, Rose Bengal, Aniline Blue, Ultramarine Blue, Chalco-oil Blue, Methylene Blue Chloride, Phthalocyanine Blue, Phthalocyanine Green and Malachite Green Octhalate; and various pigments such as acridine type, xanthene type, azo type, benzoquinone type, azine type, anthraquinone type, thioindigo type, dioxazine type, thiazine type, azomethine type, indigo type, thioindigo type, phthalocyanine type, aniline black type, thazole type and xathene type. Those are used alone or as mixtures of two or more thereof.

The content of the colorant in the toner according to the present exemplary embodiment is preferably a range of from 1% to 30% by weight based on the weight of the toner. If necessary, it is effective to use a surface-treated colorant and a pigment dispersant. Yellow toner, magenta toner, cyan toner, black toner and the like are obtained by appropriately selecting the kind of the colorants.

(3) Release Agent

Examples of the release agent used include low molecular weight polyolefins such as polyethylene, polypropylene and polybutene; silicones having a softening point by heating; aliphatic acid amides such as oleic amide, erucamide, recinoleic amide and stearic amide; plant waxes such as ester wax, carnauba wax, rice wax, candellia wax, Japan wax and jojoba oil; animal waxes such as bees wax; mineral waxes such as montan wax, ozokerite, cerecin, paraffin wax, microcrystalline wax and Fischer-Tropsch wax; petroleum waxes; and their modified products. The release agent is added in an amount of 50% by weight or less based on the weight of a toner.

(4) Other

Magnetic substances such as metals such as ferrite, magnetite, reduced iron, cobalt, nickel and manganese; their alloys; and compounds containing those metals are used as other internal additives. Various charge-controlling agents generally used such as dyes including complexes such as quaternary ammonium salt, nigrosine compound, aluminum, iron and chromium; and triphenylmethane pigments are used as a charge-controlling agent. A charge-controlling agent which is difficult to dissolve in water is preferred to control ion strength affecting aggregation and stability at the time of fusion integrating, and to reduce waste water pollution.

Examples of inorganic particles added include silica, alumina, titania, calcium carbonate, magnesium carbonate and tricalcium phosphate, which are generally used as an external additive of toner surface. Those are dispersed with ionic surfactant, polymeric acid or polymeric base and added in a wet manner.

Examples of the surfactant used in emulsion polymerization, seed polymerization, pigment dispersion, resin particle, release agent dispersion, aggregation or its stabilization in a toner production step by a wet process include anionic surfactants such as sulfuric ester salt type, sulfonic ester salt type, phosphoric ester type and soap type; and cationic surfactants such as amine salt type and quaternary ammonium salt type. Furthermore, it is effective to concurrently use nonionic surfactants such as polyethylene glycol type, alkyl phenol ethylene oxide type and polyhydric alcohol type.

The external additive used is not particularly limited, and the conventional external additives such as inorganic particles and organic particles are used. Of those, inorganic particles such as silica, titania, alumina, cerium oxide, strontium titanate, calcium carbonate, magnesium carbonate and calcium phosphate; metallic soaps such as zinc stearate; and organic resin particles such as fluorine-containing resin particles, silica-containing resin particles and nitrogen-containing resin particles are preferably used. Furthermore, the external additives may be surface-treated according to the purpose. Examples of the surface-treating agent include silane compound, silane coupling agent and silicone oil, for conducting hydrophocization treatment. The external additives are added to and mixed with toner particles. The mixing is conducted in a dry manner using the conventional mixing machine such as V-type blender, Henschel mixer and Readyge mixer. Furthermore, the mixing is conducted in a wet manner such that inorganic oxide particles are dispersed in a toner in water, followed by mixing and adhering.

(5) Properties of Toner

The toner according to the present exemplary embodiment has a volume average particle diameter in a range of preferably from 2 or about 2 μm to less than 4 μm, and more preferably from 2.5 μm to 3.5 μm. When the volume average particle diameter of the toner is 2 μm or more, the charged amount per one toner is appropriate, and toner fogging and defective cleaning may be suppressed. When the volume average particle diameter is less than 4 μm, a high definition image is obtained.

The toner according to the present exemplary embodiment has a volume average grain size distribution index GSDv in a range of preferably from 1.1 or about 1.1 to 1.4 or about 1.4, more preferably from 1.1 to 1.3, and further preferably from 1.15 to 1.24. Where the GSDv exceeds 1.4, amounts of coarse particles and fine particles are increased. As a result, aggregation of toners with each other is remarkable, and poor charging and poor transferring are liable to induce. Where the GSDv is less than 1.1, considerable difficulty is present on production.

Volume average particle diameter $D_{50v}$ and volume average grain size distribution index GSDv may be obtained by measuring with 100 μm aperture diameter using Coulter Multisizer II (manufactured by Beckman Coulter, Inc.). In this case, the measurement is conducted after that a toner is dispersed in an electrolyte aqueous solution (ISOTON II aqueous solution) and then dispersed for 30 seconds or more with ultrasonic waves. Cumulative distributions of volume and number to grain size range (channel) divided on the basis of the grain size distribution measured of a toner are drawn from small diameter side, respectively. A particle diameter when accumulation reaches 16% is defined as volume $D_{16v}$, a particle diameter when accumulation reaches 50% is defined as volume $D_{50v}$, and a particle diameter when accumulation reaches 84% is defined as volume $D_{84v}$. In this case, $D_{50v}$ represents a volume average particle diameter, and a volume average grain size distribution index (GSDv) is obtained as $(D_{84v}/D_{16v})^{1/2}$.

The toner for electrostatic image developer according to the present exemplary embodiment has a toner shape factor SF1 represented by the following formula in a range of preferably from 110 or about 110 to 140 or about 140, more preferably from 115 to 135, and further preferably from 120 to 130. Where the toner shape factor SF1 is less than 110, a shape of toner particles approaches spherical shape. As a result, poor cleaning may occur after transferring. Where the toner shape factor SF1 exceeds 140, transfer efficiency and image quality are decreased.

$$SF1=\{(ML)^2/A\}\times(\pi/4)\times 100$$

wherein ML represents the maximum length (μm) of a toner, and A represents a projected area (μm) of a toner.

The toner shape factor SF1 is measured as follows using LUZEX image analyzer (FT, manufactured by Nireco Corporation. Optical microscope image of a toner spread on a slide glass is loaded on Luzex image analyzer through a video camera. Maximum length (ML) and projected area (A) of 50 toners are measured. SF1 of the individual toners is calculated, and the average value thereof is used as a toner shape factor SF1.

The proportion of the toner in preparing a developer by mixing a toner and a carrier is that a coverage factor f of a toner to a carrier is a range of preferably from 10% to 150%, and more preferably from 40% to 100%.

$$f(\%)=\sqrt{3}/2\pi\times(D\cdot\rho c)/(d\cdot\rho t)\times C\times 100$$

wherein d represents a particle diameter of a toner, represents a particle diameter of a carrier, ρc and ρt are a true specific gravity of a carrier and a toner, respectively, and C represents a weight ratio of toner/carrier.

When the coverage factor of a toner is 10% or more, sufficient image density is obtained, and solid image becomes uniform. When the coverage factor is 150% or less, charged amount is appropriate. As a result, toner stain does not cause in a non-image site, and high quality color image is obtained.

Chargeability of a toner is preferably from 15 μC/g to 70 μC/g. When the chargeability is 15 μC/g or more, toner stain (fogging) in a non-image site may be suppressed, and a high quality color image is obtained. On the other hand, when the chargeability of a toner is 70 μC/g or less, sufficient image density is obtained.

4. Developer Cartridge and Process Cartridge

The developer cartridge of the present exemplary embodiment is a cartridge having at least the electrostatic image developer of the present exemplary embodiment contained therein. The process cartridge of the present exemplary embodiment is equipped with a developer holder, and has the electrostatic image developer of the present exemplary embodiment contained therein.

The developer cartridge of the present exemplary embodiment is preferably detachable to an image forming apparatus. Specifically, the developer cartridge of the present exemplary embodiment having the electrostatic image developer of the present exemplary embodiment contained therein is preferably used in an image forming apparatus having the constitution that the developer cartridge is detachable. The developer cartridge may have a constitution that a cartridge containing a toner alone therein and a cartridge containing a carrier alone therein are separate cartridges.

The process cartridge of the present exemplary embodiment is preferably detachable to an image forming apparatus.

The process cartridge of the present exemplary embodiment is preferably a process cartridge equipped with at least one selected from the group consisting of an image holder, a charging unit of charging the surface of the image holder, and a cleaning unit for removing a residual toner on the surface of the image holder. The process cartridge of the present exemplary embodiment may contain other members such as a static eliminator, if required and necessary.

The toner cartridge and the process cartridge may have the conventional constitution, and are referred to, for example, JP-A 2008-209489 and JP-A 2008-233736.

5. Image Forming Apparatus and Image Forming Method

The image forming apparatus of the present exemplary embodiment includes an image holder, a latent image forming unit for forming a latent image on the surface of the image holder, a developing unit for developing the electrostatic latent image using a developer to form a toner image, and a transfer unit for transferring the toner image to a material to be transferred, wherein the developer is the electrostatic image developer of the present exemplary embodiment.

The image forming method of the present exemplary embodiment includes a charging step of charging an image holder, a latent image forming step of forming a latent image on the surface of the image holder, a developing step of developing the electrostatic latent image formed on the surface of the image holder with a developer to form a toner image, and a transferring step of transferring the toner image on a material to be transferred, wherein the developer is the electrostatic image developer of the present exemplary embodiment.

The image forming apparatus according to the present exemplary embodiment may further include units other than the above-described units, such as a charging unit for charging the image holder, a fixing unit for fixing the transferred toner image to the surface of a material to be transferred, and a cleaning unit for removing residual toner on the surface of the image holder.

Figure 2:
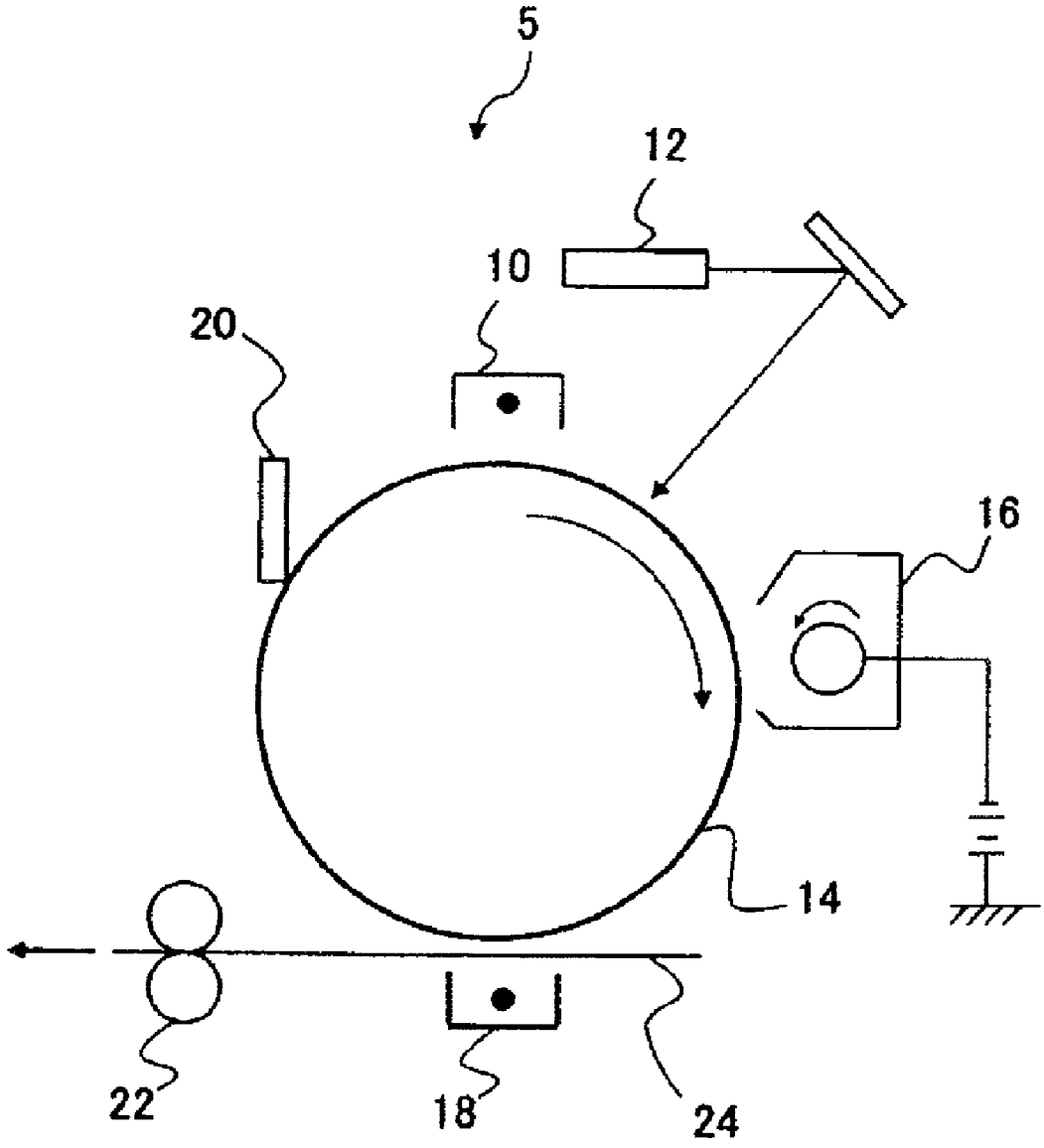
FIG. 2 is a schematic view of one example of the image forming apparatus according to the present exemplary embodiment.

Outline of one example of the image forming apparatus according to the present exemplary embodiment is shown in FIG. 2, and its constitution is described below. An image forming apparatus 5 includes a charging part 10, exposure part 12, an electrophotographic photoreceptor 14 as an image holder, a development part 16, a transferring part 18, a cleaning part 20, and a fixing part 22.

In the image forming apparatus 5, the charging part 10 as a charging unit that charges the surface of the electrophotographic photoreceptor 14, the exposure part 12 as a latent image forming unit that exposes the charged electrophotographic photoreceptor 14 to form an electrostatic latent image according to image information, the development part 16 as a development unit that develops the electrostatic latent image with a developer to form a toner image, the transferring part 18 as a transferring unit that transfers the toner image formed on the surface of the electrophotographic photoreceptor 14 to the surface of a material 24 to be transferred, and the cleaning part 20 as a cleaning unit that removes residual toner on the surface of the electrophotographic photoreceptor 14 after transferring are arranged in this order around the electrophotographic photoreceptor 14. Furthermore, the fixing part 22 as a fixing unit that fixes the transferred toner image to the material 24 to be transferred is arranged at the left side of the transferring part 18.

Operation of the image forming apparatus 5 according to the present exemplary embodiment is described below. The surface of the electrophotographic photoreceptor 14 is uniformly charged with the charging part 10 (charging step). The surface of the electrophotographic photoreceptor 14 is irradiated with light by the exposure part 12, the electrification charges on the part irradiated with light are removed, and an electrostatic image (electrostatic latent image) is formed according to image information (latent image forming step). The electrostatic image is developed with the development part 16, and a toner image is formed on the surface of the electrophotographic photoreceptor 14 (development step). For example, in the case of a digital electrophotographic copying machine using an organic photoreceptor as the electrophotographic photoreceptor 14 and using laser beam light as the exposure part 12, negative charges are given to the surface of the electrophotographic photoreceptor 14 by the charging part 10, dot-like digital latent image is formed by the laser beam light, and a toner is given to a portion irradiated with the laser beam light in the development part 16, thereby forming visualized image. In this case, minus bias is applied to the development part 16. In the transferring part 18, the material 24 to be transferred such as a paper is placed on the toner image, charges having polarity opposite that of the toner is applied to the material 24 to be transferred from the reverse side of the material 24 to be transferred, and the toner image is transferred to the material 24 to be transferred by electrostatic force (transferring step). Heat or pressure is applied to the transferred toner image by a fixing member in the fixing part 22, and the toner image is fused and fixed to the material 24 to be transferred (fixing step). On the other hand, the toner which is not transferred and is retained on the surface of the electrophotographic photoreceptor 14 is removed by the cleaning part 20 (cleaning step). One cycle is completed in a series of a process of from charging to cleaning. In FIG. 2, a toner image is directly transferred to the material 24 to be transferred, such as a paper in the transferring part 18. However, the toner image may be transferred to the material 24 to be transferred through a transfer body such as an intermediate transfer body.

The charging unit, image holder, exposure unit, developing unit, transferring unit, cleaning unit and fixing unit in the image forming apparatus 5 of FIG. 2 are described below.

(Charging Unit)

The charging part 10 as a charging unit uses an electrostatic charger such as corotron as shown in FIG. 2, but may use a conductive or semiconductive electrostatic charging roll. A contact electrostatic charger using a conductive or semiconductive electrostatic charging roll may apply direct current to the electrophotographic photoreceptor 14, or may superimpose alternating current and apply the same to the electrophotographic photoreceptor 14. For example, the surface of the electrophotographic photoreceptor 14 is charged by generating discharge in a fine space near a contact part to the electrophotographic photoreceptor 14 by the charging part 10. In general, the surface of the electrophotographic photoreceptor 14 is charged in a range of from −300V or −1,000V. The conductive or semiconductive charging roll may have a single layer structure or a multilayer structure. Mechanism of cleaning the surface of the charging roll may be provided.

(Image Holder)

The image holder has the function to form at least an electrostatic latent image (electrostatic image). The image holder preferably includes an electrophotographic photoreceptor. The electrophotographic photoreceptor 14 has a coating film containing an organic photoreceptor and the like around the outer periphery of a cylindrical conductive substrate. The coating film includes a substrate having formed thereon an undercoat layer if necessary, and a photosensitive layer including a charge generating layer containing a charge generating substance and a charge transporting layer containing a charge transporting substance, in this order. Lamination order of the charge generating layer and the charge transporting layer may invert. Those photoreceptors are a lamination type photoreceptor obtained by containing the charge generating substance and the charge transporting substance in separate layers (charge generating layer and charge transporting layer) and laminating those layers, but may be a single layer type photoreceptor in which both the charge generating substance and the charge transporting substance are contained in the same layer. A lamination type photoreceptor is preferred. Furthermore, an intermediate layer may be present between the undercoat layer and the photosensitive layer. Not only an organic photoreceptor, but other kinds of photosensitive layers such as amorphous silicon photosensitive layer may be used.

(Exposure Unit)

The exposure part 12 as an exposure unit is not particularly limited, and examples thereof include optical instruments that can expose light source such as semiconductor laser light, LED light or liquid crystal shutter light in the desired image form on the surface of the image holder.

(Developing Unit)

The developing part 16 as a developing unit has the function of developing an electrostatic latent image formed on the image holder with a developer containing toner and forming a toner image. Such a developing device is not particularly limited so long as the device has the above-described function, and may appropriately be selected according to the purpose. Examples of the developing device include the conventional developing equipments having the function that an electrostatic image developing toner is adhered to the electrostatic photoreceptor 14 using brush, roller or the like. The electrostatic photoreceptor 14 generally uses direct current voltage, and may use superimposed alternating current voltage.

(Transfer Unit)

The transfer part 18 as a transfer unit may use a transfer roll and a transfer roll pressure apparatus, using a unit which gives charges having polarity opposite that of a toner to the material 24 to be transferred, from the reverse side of the material 24 to be transferred and transfers a toner image to the material 24 to be transferred by electrostatic force, or a conductive or semiconductive roll which transfers a toner image to the surface of the material 24 to be transferred by directly contacting through the material 24 to be transferred. As transfer current to be imparted to the image holder, direct current may be applied to the transfer roll, and superimposed alternate current may be applied thereto. The transfer roll may arbitrarily be set by image region width to be charged, shape of transfer charger, opening width, process speed (peripheral speed) and the like. For the reduction of costs, a single layer foamed roll is preferably used as the transfer roll. The transfer method may be a method of directly transferring to the material 24 to be transferred, such as a paper, and may be a method of transferring to the material 24 to be transferred through an intermediate transfer body.

The intermediate transfer body may use the conventional intermediate transfer body. Materials used in the intermediate transfer body include polycarbonate resin (PC), polyvinylidene fluoride (PVDF), polyalkylene phthalate, blend material of PC/polyalkylene terephthalate (PAT), blend material of ethylene tetrafluoroethylene copolymer (ETFE)/PC, blend material of ETFE/PAT, and blend material of PC/PAT. An intermediate transfer belt using a thermosetting polyimide resin is preferred from the standpoint of mechanical strength.

(Cleaning Unit)

The cleaning part 20 as a cleaning unit may appropriately select a blade cleaning method, a brush cleaning method, a roll cleaning method and the like so long as the method cleans residual toner on the image holder. Of those methods, a method of using cleaning blade is preferably used. Examples of a material of the cleaning blade include urethane rubber, neoprene rubber and silicone rubber. Above all, polyurethane elastomer is particularly preferably used from the point of excellent abrasion resistance. However, in the case of using a toner having high transfer efficiency, the cleaning part 20 may not be used in some embodiments.

(Fixing Unit)

The fixing part 22 as a fixing unit (image fixing device) is to fix the toner image transferred to the material 24 to be transferred, by heating, pressure or pressure under heating, and is equipped with a fixing member.

(Material to be Transferred)

Examples of the material 24 to be transferred (paper) which transfers a toner image include plain papers and OHP sheets, used in a copying machine, a printer and the like in an electrophotographic system. The surface of the material to be transferred is preferably smooth as possible to further improve smoothness of the surface of an image after fixing. For example, coat papers obtained by coating the surface of plain papers with a resin or the like, and printing art papers are preferably used.

The image forming apparatus and the image forming method according to the present exemplary embodiment use the electrostatic image developer described above. Therefore, stress giving to a developer is low, and stability of image quality is excellent.

The present invention is described in more detail by reference to the following Examples and Comparative Examples, but the invention is not limited to the following Examples. Unless otherwise indicated, "parts" means "parts by weight", and "%" means "% by weight".

1. Each Measurement Method

(1) Carrier Shape Factor SF1

Shape factor SF1 of a carrier is measured using Luzex image analyzer (FT, manufactured by Nireco Corporation) as follows. Optical microscope image of a carrier spread on a slide glass is loaded on Luzex image analyzer through a video camera. Maximum length (ML) and projected area (A) of 100 carriers are measured. A value of $\{(ML)^2/A\}\times(\pi/4)\times100$ is calculated on each carrier, and the value obtained by averaging those values is obtained as carrier shape factor SF1.

(2) Grain Size of Carrier

Volume average particle diameter $D_{50v}$ and volume average grain size distribution index GSDv of a carrier are obtained by measuring with 100 μm aperture diameter using a laser scattering grain size measuring device (MICROTRACK, manufactured by Nikkiso Co., Ltd.). In this case, the measurement is conducted after that a carrier is dispersed in an electrolyte aqueous solution (ISOTON aqueous solution) and then dispersed for 30 seconds or more with ultrasonic waves. Cumulative distribution of volume to grain size range (channel) divided on the basis of the grain size distribution measured of a carrier is drawn from small diameter side. A particle diameter when accumulation reaches 16% is defined as volume $D_{16v}$, a particle diameter when accumulation reaches 50% is defined as volume $D_{50v}$, and a particle diameter when accumulation reaches 84% is defined as volume $D_{84v}$. In this case, $D_{50v}$ represents a volume average particle diameter, and a volume average grain size distribution index (GSDv) is obtained as $(D_{84v}/D_{16v})^{1/2}$.

(3) Molecular Weight and Molecular Weight Distribution of Resin

Molecular weight and molecular weight distribution of a resin are obtained under the following conditions. A device of HCL-8120 GPC, SC-8020 (manufactured by Tosoh Corporation) is used as gel permeation chromatography (GPC), two columns of TSKgel, Super HM-H (manufactured by Tosoh Corporation, 6.0 mm ID×15 cm) are used as columns, and THF (tetrahydrofuran) is used as an eluent. Experimental conditions are sample concentration: 0.5%, flow rate: 0.6 mL/min, injected amount of sample: 10 μL and measurement temperature: 40° C., and the experiment is conducted using IR detector. Calibration curve is prepared from 10 samples of polystyrene standard sample TSK standard: A-500, F-1, F-10, F-80, F-380, A-2500, F-4, F-40, F-128 and F-700, manufactured by Tosoh Corporation.

(4) Differential Scanning Calorimetry (DSC)

Melting point of a binder resin is measured using a thermal analyzer of differential scanning calorimeter (DSC-50, manufactured by Shimadzu Corporation). The measurement is conducted in a temperature rising rate of 10° C. per minute from room temperature to 150° C., and melting point is obtained by analyzing with JIS Standard (see JIS K-7121:87).

(5) Average Height Difference in Recesses and Projections, and Average Distance Between Projections Measurement of H (average height difference (μm) in recesses and projections) and L (average distance (μm) between projections) is conducted by the observation with an electron microscope. Ten carries having volume particle diameter fallen in a range of volume average particle diameter ±10% are observed, and its average is calculated.

2. Examples And Comparative Examples

(1) Preparation of Carrier Particles

Preparation of Carrier Core Material A:

45 Parts of phenol, 70 parts of formalin, 80 parts of ion-exchanged water and 500 parts of magnetite powder (volume average particle diameter: 0.25 μm, spherical shape, 0.8% KBM403 treated product) are stirred in a reaction vessel, and 15 parts of ammonia water are added to the resulting mixture. Temperature is increased to cure a phenol resin, and a reaction product is cooled and washed. Thus, a magnetic substance dispersion type carrier core material A having a weight average particle diameter of 35 μm and a shape factor SF1 of 105 is obtained by a method having the above steps. The carrier core material A has electric resistance of $10^{10}$ (Ω·m).

Preparation of Carrier Core Material B:

A magnetic substance dispersion type carrier core material B having a weight average particle diameter of 25 μm and a shape factor SF1 of 106 is obtained in the same manner as in the preparation of carrier core material A, except that the amount of water is changed to 200 parts. The carrier core material B has electric resistance of $10^{10}$ (Ω·m).

(2) Preparation of Carrier Core Material Coating Resin

38 Parts of methyl methacrylate, 50 parts of isobutyl methacrylate, 2 parts of methacrylic acid and 10 parts of perfluorooctylethyl methacrylate are random copolymerized by solution polymerization using a toluene solvent. Thus, a coating resin having a weight average molecular weight Mw of 50,000 and Tg of 85° C. is obtained.

(3) Preparation of Carrier Core Particle

Carrier Core Particle 1:

| | |
|---|---|
| Carrier core material A | 100 parts |
| Coating resin | 2.3 parts |
| Carbon black (VXC-72, manufactured by Cabot) | 0.15 parts |
| Crosslinked melamine resin particles (toluene insoluble, EPOSTAR S, manufactured by Nippon Shokubai Co., Ltd.) | 0.3 parts |
| Toluene | 14 parts |

The above coating resin, carbon black and crosslinked melamine resin particles are introduced into the toluene, and dispersed by stirring with sand mill to prepare a coating resin layer forming solution. The solution is placed in a vacuum deaeration type kneader together with the carrier core material A, followed by stirring for 10 minutes while maintaining at a temperature of 60° C. Pressure is reduced to distill away toluene, thereby forming a coating resin layer on the surface of the carrier core material A. The carrier core material is sieved with a net having an opening of 75 μm. Thus, carrier core particle 1 is obtained.

Carrier Core Particle 2:

| | |
|---|---|
| Carrier core material B | 100 parts |
| Coating resin | 2.6 parts |
| Carbon black (VXC-72, manufactured by Cabot) | 0.15 parts |
| Crosslinked melamine resin particles (toluene insoluble, EPOSTAR S, manufactured by Nippon Shokubai Co., Ltd.) | 0.5 parts |
| Toluene | 14 parts |

The above coating resin, carbon black and crosslinked melamine resin particles are introduced into the toluene, and dispersed by stirring with sand mill to prepare a coating resin layer forming solution. The solution is placed in a vacuum deaeration type kneader together with the carrier core material B, followed by stirring for 10 minutes while maintaining at a temperature of 60° C. Pressure is reduced to distill away toluene, thereby forming a coating resin layer on the surface of the carrier core material B. The carrier core material is sieved with a net having an opening of 75 μm. Thus, carrier core particle 2 is obtained.

(4) Preparation of Carrier Core Particle Dispersion

Carrier Core Particle Dispersion 1:

| | |
|---|---|
| Carrier core particle 1 | 100 parts |
| Ion-exchanged water | 300 parts |
| Anionic surfactant (DOWFAX 2A1, manufactured by Dow Chemical Company) | 1 part |

The above ion-exchanged water and anionic surfactant are introduced into a 500 ml plastic bottle, and the above carrier core particle 1 is then introduced into the plastic bottle. The plastic bottle is covered with a lid. The plastic bottle is placed on a ball mill apparatus, and rotated at 60 rpm to stir for 1 hour. Thus, carrier core particle dispersion 1 is obtained.

Carrier Core Particle Dispersion 2:

Carrier core particle dispersion 2 is obtained in the same manner as in the above preparation of the carrier core particle dispersion 1, except for using the carrier core particle 2 in place of the carrier core particle 1.

(5) Preparation of Conductive Particle-Dispersed Particle (Particle for Forming Projections)

Preparation of Resin Particle Dispersion:

| | |
|---|---|
| Styrene | 500 parts |
| Acrylic acid | 20 parts |
| Surfactant (DOWFAX 2A1, manufactured by Dow Chemical Company) | 10 parts |
| Ammonium persulfate | 7 parts |
| Ion-exchanged water | 1,000 parts |

The above materials are stirred at 1,000 rpm for 60 minutes to obtain an emulsion. Temperature of the emulsion is then increased to 75° C., and the emulsion is maintained for 3 hours. During the period, stirring is continued at 200 rpm. Thus, a resin particle dispersion having resin particles having a volume average particle diameter of 200 nm and a weight average molecular weight Mw of 50,000 dispersed in a solid content of 33% by weight is obtained. Volume average particle diameter of the resin particles is measured using a laser diffraction type grain size distribution analyzer (LA-700, manufactured by Horiba, Ltd.).

Preparation of Carbon Black Dispersion:

| | |
|---|---|
| Carbon black (VXC-72, manufactured by Cabot) | 50 parts |
| Anionic surfactant (NEWLEX R, manufactured by NOF Corporation) | 2 parts |
| Ion-exchanged water | 198 parts |

The above components are mixed, and pre-dispersed by a homogenizer (ULTRATARAX, manufactured by IKA) for 10 minutes. Dispersion treatment is then conducted under a pressure 245 MPa for 15 minutes using ULTIMIZER (counter collision type wet pulverizer, manufactured by Sugino Machine Limited). Thus, a carbon black dispersion having a central particle diameter of 188 nm and a solid content of 20.0% by weight is obtained.

Preparation of Conductive Particle-Dispersed Particle 1:

| | |
|---|---|
| Resin particle dispersion | 1,500 parts |
| Magnetite particle (BL-500, manufactured by Titan Kogyo, Ltd.) | 500 parts |
| Carbon black dispersion (20.0% by weight) | 25 parts |
| Surfactant (DOWFAX 2A1, manufactured by Dow Chemical Company) | 3 parts |
| Aggregating agent (poly aluminum chloride aqueous solution (10% by weight)) | 2 parts |

The above materials excluding the aggregating agent are mixed in a flask for 20 minutes. The aggregating agent is then added to the flask, and the resulting mixture is pre-dispersed at 5,000 rpm with a disperser (ULTRATARAX, manufactured by IRA). Temperature of the flask is increased to 70° C. with an oil bath while stirring at 500 rpm, and the flask is maintained for 30 minutes. It is confirmed that particles having a volume average particle diameter of 2.8 μm are formed. Filtration and redispersion to ion-exchanged water are repeated to wash the particles. Thus, conductive particle-dispersed particle 1 is obtained.

Preparation of Conductive Particle-Dispersed Particle 2:

In the preparation of the conductive particle-dispersed particle 1, the procedures up to the pre-dispersion are similarly conducted. Temperature of the flask is increased to 70° C. with an oil bath while stirring the flask at 500 rpm, and the flask is maintained for 60 minutes. It is confirmed that particles having a volume average particle diameter of 3.5 μm are formed. Filtration and redispersion to ion-exchanged water are repeated to wash the particles, followed by drying. Thus, conductive particle-dispersed particle 2 is obtained.

(6) Preparation of Conductive Particle-Dispersed Particle Dispersion (Particle Dispersion for Forming Projections)

Preparation of Conductive Particle-Dispersed Particle Dispersion 1:

| | |
|---|---|
| Conductive particle-dispersed particle 1 | 100 parts |
| Ion-exchanged water | 300 parts |
| Cationic surfactant (CATION AB, manufactured by NOF Corporation) | 2 parts |

The above ion-exchanged water and cationic surfactant are introduced into a 500 ml plastic bottle, and the above conductive particle-dispersed particle 1 is then introduced into the plastic bottle. The plastic bottle is covered with a lid. The plastic bottle is placed on a ball mill apparatus, and rotated at 60 rpm to stir for 1 hour. Thus, conductive particle-dispersed particle dispersion 1 is obtained.

Preparation of Conductive Particle-Dispersed Particle Dispersion 2:

Conductive particle-dispersed particle dispersion 2 is obtained in the same manner as in the above preparation of the conductive particle-dispersed particle dispersion 1, except for using the conductive particle-dispersed particle 2 in place of the conductive particle-dispersed particle 1.

(7) Preparation of Carrier

Preparation of Carrier 1:

The conductive particle-dispersed particle 1 is gradually added to 100 parts of the carrier core particle dispersion while stirring the carrier core particle dispersion, and the conductive particle-dispersed particle 1 is finally added in an amount of 5 parts. While mixing the resulting mixture by stirring, the mixture is heated to gradually increase the temperature, and the mixture is held at 70° C. for 90 minutes. Thus, the conductive particle-dispersed particles are electrostatically adhered to the carrier core particle, thereby performing prefixation. 2 parts of an anionic surfactant (DOWFAX 2A1, manufactured by Dow Chemical Company) are further added to the mixture, and the resulting mixture is heated and held at 95° C. for 2 hours. The mixture is cooled, washed with ion-exchanged water and dried. Carrier particles having recesses and projections are confirmed with SEM. Thus, carrier 1 having a volume average particle diameter of 38.7 μm an average height difference in recesses and projections of 2.4 μm, an average distance between projections of 8.6 μm and a shape factor SF1 of 150 is obtained. The results obtained are shown in Table 1.

Preparation of Carriers 2 to 9:

Carriers 2 to 9 are obtained in the same manner as in carrier 1. The degree of recesses and projections is changed by the combination of the carrier core particle dispersion and the conductive particle-dispersed particle dispersion, and additionally the holding time of the formulation at 95° C. Height difference in recesses and projections could be decreased as the holding time is long. The measurement results of a volume average particle diameter, an average height difference in recesses and projections, an average distance between projections and a shape factor SF1 are shown in Table 1.

TABLE 1

| | Carrier core particle dispersion | | Conductive particle-dispersed particle | | Volume average particle diameter | H Average height difference in recesses and projection | L Average distance between projections | Shape factor |
|---|---|---|---|---|---|---|---|---|
| | Kind | Parts | Kind | Parts | (μm) | (μm) | (μm) | SF1 |
| Carrier 1 | 1 | 100.0 | 1 | 5.0 | 38.7 | 2.4 | 8.6 | 150 |
| Carrier 2 | 1 | 100.0 | 2 | 7.0 | 40.5 | 2.8 | 8.9 | 148 |
| Carrier 3 | 2 | 100.0 | 1 | 10.0 | 28.7 | 2.1 | 6.7 | 165 |
| Carrier 4 | 2 | 100.0 | 2 | 14.0 | 29.5 | 2.7 | 6.3 | 158 |
| Carrier 5 | 1 | 100.0 | 1 | 5.0 | 36.9 | 2.0 | 8.4 | 160 |
| Carrier 6 | 1 | 100.0 | 1 | 5.0 | 36.5 | 1.4 | 8.3 | 156 |
| Carrier 7 | 1 | 100.0 | 1 | 3.0 | 38.3 | 2.2 | 12.6 | 154 |
| Carrier 8 | 1 | 100.0 | 1 | 2.5 | 38.0 | 2.1 | 14.5 | 150 |
| Carrier 9 | 1 | 100.0 | — | — | 35.8 | — | — | 108 |

(8) Preparation of Toner (for Heat Fixation)

Preparation of Crystalline Polyester Resin Particle Dispersion (A):

100 mol % of decanedicarboxylic acid, 100 mol % of nonanediol and 0.3% by weight of dibutyltin oxide as a catalyst are placed in a heat dried three-necked flask. Air in the flask is replaced with nitrogen gas by pressure reduction operation to form inert atmosphere, and stirring and reflux are conducted by mechanical stirring at 180° C. for 5 hours.

Temperature is gradually increased to 230° C. under reduced pressure, and stirring is conducted for 2 hours. When the mixture in the flask became viscous state, the mixture is air cooled to stop the reaction. Thus, a crystalline polyester resin (A) is synthesized.

The crystalline polyester resin (A) obtained had a weight average molecular weight (Mw) of 23,800 and a number average molecular weight (Mn) of 7,500 by molecular weight measurement (in terms of polystyrene) with gel permeation chromatography.

Melting point (Tm) of the crystalline polyester resin (A) is measured using differential scanning calorimeter (DSC) by the measurement method described before. As a result, the resin (A) showed clear endothermic peak, and endothermic peak temperature is 72.4° C.

Resin particle dispersion (A) is then prepared using the crystalline polyester resin (A).

| | |
|---|---|
| Crystalline polyester resin (A) | 90 parts |
| Ionic surfactant NEOGEN PK (manufactured by Daiichi Kogyo Seiyaku Co., Ltd.) | 1.8 parts |
| Ion-exchanged water | 210 parts |

The above materials are mixed, heated to 100° C. and sufficiently dispersed with ULTRATALAX T50, manufactured by IKA. Dispersion treatment is then conducted with a pressure discharge type Gaulin homogenizer for 1 hour by heating to 110° C. Thus, resin particle dispersion (A) having a central diameter of 230 nm and a solid content of 20% by weight is obtained. Synthesis of noncrystalline polyester resin (1):

| | |
|---|---|
| Bisphenol A ethylene oxide 2 mol adduct | 30 mol % |
| Bisphenol A propylene oxide adduct | 70 mol % |
| Terephthalic acid | 80 mol % |
| Fumaric acid | 20 mol % |

The above monomers are charged in a flask equipped with a stirring device, a nitrogen introduction pipe, a temperature sensor and a rectifier. Temperature of the resulting mixture is increased to 190° C. over 1 hour. After confirming the reaction system is uniformly stirred, tin dioctanoate is introduced in an amount of 1.0% by weight based on the weight of the monomers. The temperature is increased to 240° C. from 190° C. over 6 hours while distilling away water formed, and dehydrocondensation reaction is continued at 240° C. for 2 hours. Thus, noncrystalline polyester resin (1) having a glass transition point of 62° C., an acid value of 12.7 mg KOH/g, a weight average molecular weight of 18,300 and a number average molecular weight of 4,200 is obtained.

Synthesis of Noncrystalline Polyester Resin (2):

| | |
|---|---|
| Bisphenol A propylene oxide 2 mol adduct | 80 mol % |
| Trimethylol propane | 20 mol % |
| Trimellitic anhydride | 5 mol % |
| Terephthalic acid | 85 mol % |
| Dodecenylsuccinic acid | 10 mol % |

The above monomers except for trimellitic anhydride are charged in a 5 liters flask equipped with a stirring device, a nitrogen introduction pipe, a temperature sensor and a rectifier. Temperature of the resulting mixture is increased to 190° C. over 1 hour. After confirming the reaction system is uniformly stirred, tin dihexanoate is introduced in an amount of 0.6% by weight. The temperature is increased to 240° C. from 190° C. over 6 hours while distilling away water formed, dehydrocondensation reaction is continued at 240° C., and reaction is conducted until a softening point reaches 110° C. The temperature is decreased to 190° C., 5 mol % of trimellitic anhydride is gradually introduced, and reaction is continued at the temperature for 1 hour. Thus, noncrystalline polyester resin (2) having a glass transition point of 62.2° C., an acid value of 16 mg KOH/g, a weight average molecular weight of 52,000 and a number average molecular weight of 8,200 is obtained.

Preparation of Resin Particle Dispersion (1):

| | |
|---|---|
| Noncrystalline polyester resin (1) | 100 parts |
| Ethyl acetate | 50 parts |
| Isopropyl alcohol | 15 parts |

Ethyl acetate is introduced into a separable flask, the above resins are gradually introduced into the flask. The resulting mixture is stirred with a three-one motor, and the resins are completely dissolved, thereby obtaining an oil phase. 10% ammonia aqueous solution is gradually added dropwise to the oil phase being stirred by a dropper in an amount such that the total amount is 3 parts. 230 parts of ion-exchanged water are gradually added dropwise at a rate of 10 ml/min to perform phase inversion emulsification, and the solvent is removed with an evaporator while reducing pressure. Thus, resin particle dispersion (1) including the noncrystalline polyester resin (1) is obtained. The composite resin particle obtained had a volume average particle diameter of 150 nm. Resin particle concentration is adjusted to 20% with ion-exchanged water.

Preparation of Resin Particle Dispersion (2):

Resin particle dispersion (2) is obtained in the same manner as in the preparation of resin particle dispersion (1), except for changing the noncrystalline polyester resin (1) to the noncrystalline polyester resin (2). The composite resin particle obtained had a volume average particle diameter of 180 nm. Resin particle concentration is adjusted to 20% with ion-exchanged water.

Preparation of Colorant Particle Dispersion:

| | |
|---|---|
| Blue pigment (Copper Phthalocyanine B 15:3, manufactured by Dainichiseika Color & Chemical Mfg. Co., Ltd.) | 50 parts |
| Ionic surfactant NEOGEN RK (manufactured by Dai-Ichi Kogyo Seiyaku Co., Ltd.) | 5 parts |
| Ion-exchanged water | 195 parts |

The above components are mixed and dispersed with a homogenizer (ULTRATALAX, manufactured by IKA) for 10 minutes. Dispersion treatment is then conducted under a pressure of 245 MPa for 20 minutes using ULTIMIZER (counter collision type wet pulverizer, manufactured by Sugino Machine Limited). Thus, colorant particle dispersion having a center particle diameter of the colorant particle of 185 nm and a solid content of 20.0% by weight is obtained.

Preparation of Release Agent Particle Dispersion:

| | |
|---|---|
| Olefin wax (melting point: 88° C.) | 90 parts |
| Ionic surfactant NEOGEN RK (manufactured by Dai-Ichi Kogyo Seiyaku Co., Ltd.) | 1.8 parts |
| Ion-exchanged water | 210 parts |

The above components are heated to 100° C. and sufficiently dispersed with ULTRATALAX T50, manufactured by IKA. Dispersion treatment is then conducted with a pressure discharge type Gaulin homogenizer for 1 hour by heating to 110° C. Thus, release agent particle dispersion having a center diameter of 175 nm and a solid content of 20% by weight is obtained.

Preparation of Toner Particle 1:

| | |
|---|---|
| Resin particle dispersion (1) | 60 parts |
| Resin particle dispersion (2) | 60 parts |
| Crystalline polyester resin dispersion (A) | 10 parts |
| Colorant particle dispersion | 15 parts |
| Release agent particle dispersion | 15 parts |
| Ion-exchanged water | 80 parts |

The above components are sufficiently mixed and dispersed in a round stainless steel flask with ULTRATALAX T50. 0.20 parts of poly aluminum chloride are added to the flask, and dispersion operation is continued with ULTRATALAX. The flask is heated to 48° C. while stirring the flask in a heating oil bath. The flask is held at 48° C. for 60 minutes, and a mixed liquid of 20 parts of the resin particle dispersion (1) and 20 parts of the resin particle dispersion (2) is then mildly added to the flask.

pH in the system is adjusted to 8.0 with 0.5 mol/liter sodium hydroxide aqueous solution, and the stainless steel flask is sealed. The flask is heated to 90° C. while continuing stirring with a magnetic force seal and held for 3 hours.

After completion of the reaction, the flask is cooled, and the mixture in the flask is filtered and sufficiently washed with ion-exchanged water, followed by solid-liquid separation with Nutsche suction filtration. The solid is re-dispersed in 1 liter of ion-exchanged water at 40° C., followed by stirring and washing at 300 rpm for 15 minutes.

The above operation is repeated five times. When the filtrate had pH of 7.5 to 8.0 and electric conductivity of 7.0 μS/cmt or less, solid-liquid separation is conducted using No. 5A filter paper by Nutsche suction filtration. Vacuum drying is continued for 12 hours. Thus, toner particle 1 is obtained.

Particle diameter of the toner particle 1 is measured with Coulter counter. As a result, volume average particle diameter $D_{50v}$ is 3.8 μm, and grain size distribution coefficient GSDv is 1.22. Shape factor SF1 of the toner particle 1 by shape observation with LUZEX is 136, and the shape is potato shape.

Preparation of Toner Particle 2:

| | |
|---|---|
| Resin particle dispersion (1) | 55 parts |
| Resin particle dispersion (2) | 5 parts |
| Crystalline polyester resin dispersion (A) | 10 parts |
| Colorant particle dispersion | 20 parts |
| Release agent particle dispersion | 20 parts |
| Ion-exchanged water | 40 parts |

The above components are sufficiently mixed and dispersed in a round stainless steel flask with ULTRATALAX T50. 0.20 parts of poly aluminum chloride are added to the flask, and dispersion operation is continued with ULTRATALAX. The flask is heated to 45° C. while stirring the flask in a heating oil bath. The flask is held at 45° C. for 60 minutes, and a mixed liquid of 20 parts of the resin particle dispersion (1) and 20 parts of the resin particle dispersion (2) is mildly added to the flask.

pH in the system is adjusted to 8.0 with 0.5 mol/liter sodium hydroxide aqueous solution, and the stainless steel flask is sealed. The flask is heated to 90° C. while continuing stirring with a magnetic force seal and held for 3 hours.

After completion of the reaction, the flask is cooled, and the mixture in the flask is filtered and sufficiently washed with ion-exchanged water, followed by solid-liquid separation by Nutsche suction filtration. The solid obtained is re-dispersed in 1 liter of ion-exchanged water at 40° C., followed by stirring and washing at 300 rpm for 15 minutes.

The above operation is repeated five times. When the filtrate had pH of 7.5 to 8.0 and electric conductivity of 7.0 μS/cmt or less, solid-liquid separation is conducted using No. 5A filter paper by Nutsche suction filtration. Vacuum drying is continued for 12 hours. Thus, toner particle 2 is obtained.

Particle diameter of the toner particle 2 is measured with Coulter counter. As a result, a volume average diameter $D_{50}$ is 2.8 μm, and grain size distribution coefficient GSDv is 1.24. Shape factor SF1 of the toner particle 2 by shape observation with LUZEX is 132, and the shape is potato shape.

(9) Preparation of Toner (for Pressure Fixation)

Synthesis of 2-methyl-2-[N-(tert-butyl)-N-(1-diethoxyphosphoryl-2,2-dimethylpropyl)-aminoxy]-propionic acid (MBPAP)

500 parts of degassed toluene, 35.9 parts of CuBr, 15.9 parts of copper powder and 86.7 parts of N,N,N',N',N''-pentamethyldiethylene triamine are introduced into a glass vessel purged with nitrogen. 500 ml of degassed toluene, 42.1 parts of 2-bromo-2-methylpropionic acid and 78.9 parts of N-tert-butyl-N-(1-diethylphosphono-2,2-dimethylpropyl)nitroxide are introduced into the glass vessel while stirring, and the resulting mixture is stirred at room temperature for 90 minutes. The reaction medium is filtered, and a toluene-filtered product is washed with 1,500 parts of $NH_4Cl$ saturated aqueous solution two times. The substance obtained is washed with pentane, and then vacuum dried. Thus, 2-methyl-2-[N-(tert-butyl)-N-(1-diethoxyphosphoryl-2,2-dimethylpropyl)-aminoxy]-propionic acid (MBPAP) is obtained.

Molar mass of the prepared MBPAP obtained by mass spectrometry is 381.44 g/mol ($C_{17}H_{36}NO_6P$), and it is confirmed that MBPAP is the objective product.

Preparation of Block Copolymer Resin:

200 parts of styrene monomer and 14.8 parts of MBPAP are added to a glass vessel equipped with a reflux condenser, a nitrogen introduction pipe and a stirrer, and the resulting mixture is well mixed at 80° C. under nitrogen stream. Temperature is increased to 110° C., and polymerization of styrene is conducted. Molecular weight is measured as needed with GPC, and when a number average molecular weight of styrene reached 5,100, the amount of residual styrene is measured with weight loss method to obtain a degree of polymerization (conversion). As a result, it is found to be 99.5%. 212 parts of butyl acrylate are added, polymerization is continued at 130° C., and chain extension with butyl acrylate is conducted. When a number average molecular weight of butyl acrylate unit is 5,400 and the total with styrene chain polymerized first is 10,500 in number average molecular weight, the mixture is cooled to room temperature. A polymerization product is taken out by dissolving in 200 ml of THF, and added dropwise to 3,000 parts of methanol to re-precipitate a block copolymer. The precipitate is filtered, and washed with 1,000 parts of methanol repeatedly, followed by vacuum drying at 40° C. Thus, a block copolymer resin of styrene and butyl acrylate is obtained.

Using the above polymerization apparatus, styrene homopolymer having a number average molecular weight of 5,100 is prepared by the same operation using 50 parts of styrene and 3.7 parts of MBPAP, and similarly purified. As a result of measurement of glass transition point (Tg), it is found to be 78° C. Homopolymer having a number average molecular weight of 5,400 is similarly polymerized using 53 parts of butyl acrylate and 3.7 parts of MBPAP. As a result of confirming Tg after purification, it is found to be −35° C.

As a result of measurement of a temperature at which a block copolymer resin (1) obtained has flow tester viscosity of $10^4$ Pa·s, the temperature is 95° C. in 0.5 MPa (5 kgf/cm$^2$) (T(0.5 MPa)) and 53° C. in 30 MPa (300 kgf/cm$^2$) (T(30 MPa)), and T(0.5 MPa)−T (30 MPa) is 42° C.

Preparation of Resin Particle Dispersion (3):

120 parts of methyl ethyl ketone (MEK) having 8 parts of sorbitan sesquioleate and 0.8 parts of sodium dodecylbenzenesulfonate dissolved therein are added to 400 parts of the block copolymer resin. The resulting mixture is introduced into a reactor equipped with a reflux condenser, a stirrer, an ion-exchanged water dropping device and a heating device, and well mixed at 65° C. Heat mixing is conducted at 65° C. for 1 hour, and 1,600 parts of ion-exchanged water are added dropwise at a rate of 1 g/min to conduct inverse phase emulsification of the block copolymer resin. The inverse phase emulsified product is cooled, and MEK is removed from an emulsion at 60° C. under reduced pressure using an evaporator. Thus, resin particle dispersion (3) having a volume average particle diameter of resin particles of 200 nm and a solid content of 20.2% is obtained.

Preparation of Toner Particle 3:

| | |
|---|---|
| Resin particle dispersion (3) | 120 parts |
| Colorant particle dispersion | 20 parts |
| Release agent particle dispersion | 20 parts |
| Ion-exchanged water | 40 parts |

The above components are sufficiently mixed and dispersed in a round stainless steel flask with ULTRATALAX T50. 0.20 parts of poly aluminum chloride are added to the flask, and dispersion operation is continued with ULTRATALAX. The flask is heated to 45° C. while stirring the flask in a heating oil bath. The flask is held at 45° C. for 60 minutes, and 40 parts of the resin particle dispersion (3) are mildly added to the flask.

pH in the system is adjusted to 8.0 with 0.5 mol/liter sodium hydroxide aqueous solution, and the stainless steel flask is sealed. The flask is heated to 90° C. while continuing stirring with a magnetic force seal and held for 3 hours.

After completion of the reaction, the flask is cooled, and the mixture in the flask is filtered and sufficiently washed with ion-exchanged water, followed by solid-liquid separation by Nutsche suction filtration. The solid obtained is re-dispersed in 1 liter of ion-exchanged water at 40° C., followed by stirring and washing at 300 rpm for 15 minutes.

The above operation is repeated five times. When the filtrate had pH of 7.5 to 8.0 and electric conductivity of 7.0 μS/cmt or less, solid-liquid separation is conducted using No. 5A filter paper by Nutsche suction filtration. Vacuum drying is continued for 12 hours. Thus, toner particle 3 is obtained.

Particle diameter of the toner particle 3 is measured with Coulter Multisizer II. As a result, a volume average diameter $D_{50}$ is 3.5 μm, and grain size distribution coefficient GSDv is 1.25. Shape factor SF1 of the toner particle obtained by shape observation with LUZEX is 130, and the shape is potato shape.

(10) Preparation of Developer 0.8 parts of decylsilane-treated hydrophobic titania having an average particle diameter of 15 nm and 1.3 parts of hydrophobic silica having an average particle diameter of 30 nm (NY50, manufactured by Nippon Aerosil Co., Ltd.) are added to 100 parts of the respective toner particles 1 to 3, and the resulting mixtures are blended at 30 m/sec for 10 minutes using Henschel mixer. Coarse particles are removed using a sieve of 45 μm opening. Thus, external toners 1 to 3 are prepared. 5 parts or 8 parts of the external toners 1 to 3 and 100 parts of the carriers 1 to 9 are variously combined. The resulting respective mixtures are stirred at 40 rpm for 20 minutes using V blender, and then sieved with a sieve having 125 μm opening. Thus, developers 1 to 18 are obtained.

As a result of confirming each developer including 5 parts of the toner and 100 parts of the carrier, the toner selectively adhered to recesses in the case that the surface of the carrier has given recesses and projections. This is due to that carbon black concentration in projections is high and toner charge imparting property in recesses is relatively high. It is observed that the number of the toner adhered to projections is smaller than the number of the toner adhered to the recesses.

TABLE 2

| | Toner | | Carrier | | | | | |
|---|---|---|---|---|---|---|---|---|
| | | | | | H Average height difference in recesses and projections | | L Average distance between recesses | |
| Developer | Sample | t Volume average particle diameter (μm) | Sample | Volume average particle diameter (μm) | Average value (μm) | Ratio to toner particle diameter | Average value (μm) | Ratio to toner particle diameter |
| Developer 1 | 1 | 3.8 | 1 | 38.7 | 2.4 | 0.63 t | 8.6 | 2.26 t |
| Developer 2 | 1 | 3.8 | 2 | 40.5 | 2.8 | 0.74 t | 8.9 | 2.34 t |
| Developer 3 | 1 | 3.8 | 3 | 28.7 | 2.1 | 0.55 t | 6.7 | 1.76 t |
| Developer 4 | 1 | 3.8 | 4 | 29.5 | 2.7 | 0.71 t | 6.3 | 1.66 t |
| Developer 5 | 1 | 3.8 | 5 | 36.9 | 2.0 | 0.53 t | 8.4 | 2.21 t |
| Developer 6 | 2 | 2.8 | 1 | 38.7 | 2.4 | 0.86 t | 8.6 | 3.07 t |
| Developer 7 | 2 | 2.8 | 2 | 40.5 | 2.8 | 1.00 t | 8.9 | 3.18 t |
| Developer 8 | 2 | 2.8 | 3 | 28.7 | 2.1 | 0.75 t | 6.7 | 2.39 t |
| Developer 9 | 2 | 2.8 | 4 | 29.5 | 2.7 | 0.96 t | 6.3 | 2.25 t |
| Developer 10 | 2 | 2.8 | 5 | 36.9 | 2.0 | 0.71 t | 8.4 | 3.00 t |
| Developer 11 | 3 | 3.5 | 1 | 38.7 | 2.4 | 0.69 t | 8.6 | 2.54 t |
| Developer 12 | 3 | 3.5 | 2 | 40.5 | 2.8 | 0.80 t | 8.9 | 2.54 t |
| Developer 13 | 3 | 3.5 | 4 | 29.5 | 2.7 | 0.77 t | 6.3 | 1.86 t |
| Developer 14 | 1 | 3.8 | 6 | 36.5 | 1.4 | 0.37 t | 8.3 | 2.18 t |
| Developer 15 | 2 | 2.8 | 7 | 38.3 | 2.2 | 0.79 t | 12.6 | 4.50 t |
| Developer 16 | 2 | 2.8 | 8 | 38.0 | 2.1 | 0.75 t | 14.5 | 5.17 t |
| Developer 17 | 1 | 3.8 | 9 | 35.8 | — | — | — | — |
| Developer 18 | 3 | 3.5 | 9 | 35.8 | — | — | — | — |

(10) Evaluation of Developer

The developers 1 to 10 and 14 to 17 are evaluated with the commercially available electrophotographic copying machine Docu Color a450 (manufactured by Fuji Xerox Co., Ltd.). Under the environment of 28° C. and 85% RH, output of an image containing a solid image and a halftone image having an image area ratio of 5% is performed with OKTOP paper (A4 paper, coat paper), manufactured by Fuji Xerox Corporation at the use beginning (10th print) using a developer containing a toner in an amount of 5 parts per 100 parts of a carrier. Subsequently, printing of 100 A4 blank papers (no image area) is carried out, and output of an image containing a solid image and a halftone image having an image area ratio of 5% is again performed with OKTOP paper (A4 paper, coat paper).

Separately, output of an image containing a solid image and a halftone image having an image area ratio of 5% is performed with OKTOP paper (A4 paper, coat paper) at the use beginning using a developer containing a toner in an amount of 8 parts per 100 parts of a carrier. Print pattern for evaluation is shown in FIG. 3.

Figure 3:
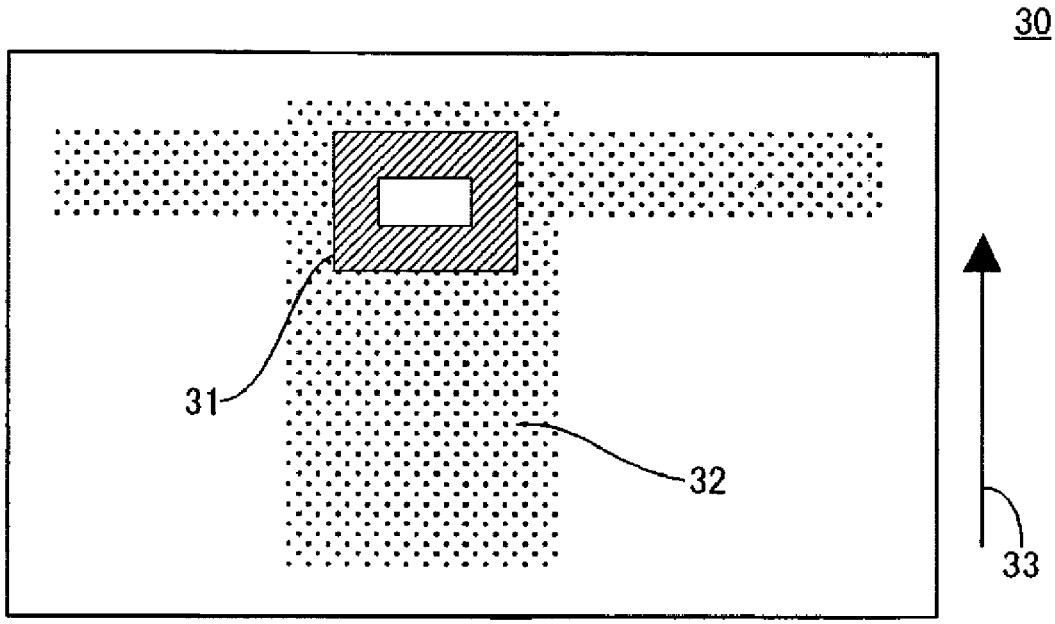
FIG. 3 is a print pattern for evaluation.

In a print pattern 30 shown in FIG. 3, the numeral 31 denotes a solid image, the numeral 32 denotes a halftone image, and the numeral 33 is a direction of printing.

The developers 11 to 13 and 18 are evaluated with the commercially available electrophotographic copying machine Docu Color a450 (manufactured by Fuji Xerox Co., Ltd.), but a fixing machine is modified. That is, image side pressure roll is changed to high hardness roll having SUS tube coated with Teflon (registered trade mark), and fixing pressure is changed to about 10 MPa (100 kgf/cm$^2$).

Solid image density of print and performance of halftone are checked. The results obtained are shown in Table 3.

Solid Image Density:

Solid image density is measured with a density measuring instrument X-rite 404A, manufactured by X-rite. The measurement standard is shown below.

A: Density difference is less than 0.1 as compared with initial density of 5 parts of toner B: Density difference is from 0.1 to 0.2 as compared with initial density of 5 parts of toner C: Density difference is larger than 0.2 as compared with initial density of 5 parts of toner The results obtained are shown in Table 3 below.

Halftone:

Evaluation standard regarding performance of halftone is shown below.

A: Totally uniform halftone

B: Halftone is disrupted (missing parts are occasionally observed)

C: Halftone part just after solid image part is pale.

The results obtained are shown in Table 3

TABLE 3

| Example and Comparative Example | Developer | Initial (Toner 5 parts) Solid image density | Initial (Toner 5 parts) Halftone | After printing 100 blank sheets Solid image density Measured value | After printing 100 blank sheets Solid image density Density difference | After printing 100 blank sheets Solid image density Judgment | After printing 100 blank sheets Halftone |
|---|---|---|---|---|---|---|---|
| Example 1 | 1 | 1.85 | A | 1.84 | 0.01 | A | A |
| Example 2 | 2 | 1.87 | A | 1.85 | 0.02 | A | A |
| Example 3 | 6 | 1.90 | A | 1.83 | 0.07 | A | A |
| Example 4 | 7 | 1.85 | A | 1.82 | 0.03 | A | B |
| Example 5 | 8 | 1.88 | A | 1.85 | 0.03 | A | A |
| Example 6 | 9 | 1.85 | A | 1.80 | 0.05 | A | A |
| Example 7 | 10 | 1.88 | A | 1.83 | 0.05 | A | A |
| Example 8 | 11 | 1.90 | A | 1.85 | 0.05 | A | A |
| Example 9 | 12 | 1.85 | A | 1.81 | 0.04 | A | A |
| Example 10 | 13 | 1.86 | A | 1.83 | 0.03 | A | A |
| Example 11 | 15 | 1.86 | A | 1.79 | 0.07 | A | B |
| Example 12 | 3 | 1.88 | A | 1.80 | 0.08 | A | A |
| Example 13 | 4 | 1.86 | A | 1.77 | 0.09 | A | B |
| Example 14 | 5 | 1.90 | A | 1.85 | 0.05 | A | B |
| Comparative Example 1 | 14 | 1.92 | A | 1.81 | 0.11 | B | B |
| Comparative Example 2 | 16 | 1.88 | A | 1.77 | 0.11 | B | B |
| Comparative Example 3 | 17 | 1.85 | A | 1.64 | 0.21 | C | B |
| Comparative Example 4 | 18 | 1.82 | A | 1.55 | 0.27 | C | C |

| Example and Comparative Example | Initial (toner 8 parts) Solid image density Measured value | Initial (toner 8 parts) Solid image density Density difference | Initial (toner 8 parts) Solid image density Judgment | Initial (toner 8 parts) Halftone | Comprehensive judgment |
|---|---|---|---|---|---|
| Example 1 | 1.87 | −0.02 | A | A | A |
| Example 2 | 1.90 | −0.03 | A | A | A |
| Example 3 | 1.90 | 0.00 | A | A | A |
| Example 4 | 1.91 | −0.06 | A | B | B |
| Example 5 | 1.92 | −0.04 | A | A | A |
| Example 6 | 1.86 | −0.01 | A | A | A |
| Example 7 | 1.90 | −0.02 | A | A | A |
| Example 8 | 1.93 | −0.03 | A | A | A |
| Example 9 | 1.88 | −0.03 | A | A | A |
| Example 10 | 1.89 | −0.03 | A | A | A |
| Example 11 | 1.89 | −0.03 | A | B | B |
| Example 12 | 1.78 | 0.10 | B | A | A |
| Example 13 | 1.78 | 0.08 | A | B | B |
| Example 14 | 1.88 | 0.02 | A | B | B |
| Comparative Example 1 | 1.88 | 0.04 | A | C | C |

TABLE 3-continued

| | | | | | |
|---|---|---|---|---|---|
| Comparative Example 2 | 1.86 | 0.02 | A | C | C |
| Comparative Example 3 | 1.87 | −0.02 | A | C | C |
| Comparative Example 4 | 1.87 | −0.05 | A | C | C |

Examples 1 to 14 are excellent in solid image density and stability of halftone. Furthermore, uniform halftone is obtained even though toner concentration in the developer is increased.

On the other hand, Comparative Examples 1 to 4 are poor in particularly stability of halftone. This is due to that as a result of observing toner after printing 100 blank sheets with electron microscope, the external additive is entombed in the surface of a toner, and by the deterioration of transferability due to this, halftone is disturbed.

Furthermore, the halftone part just after solid image part is pale when the toner concentration is increased. This is due to that electric resistance of magnetic brush is too high by increasing toner concentration.

The above-described constitution permitted to provide an electrostatic image developer in which stress to a toner is reduced, stability of development and transfer is excellent, variation of electric resistance of magnetic brush to variation of toner concentration in the developer is small, and an image of high image quality is stably obtained.

The foregoing description of the embodiments of the present invention has been provided for the purposes of illustration and description. It is not intended to be exhaustive or to limit the invention to the precise forms disclosed. Obviously, many modifications and variations will be apparent to practitioners skilled in the art. The embodiments are chosen and described in order to best explain the principles of the invention and its practical applications, thereby enabling others skilled in the art to understand the invention for various embodiments and with the various modifications as are suited to the particular use contemplated. It is intended that the scope of the invention defined by the following claims and their equivalents.

What is claimed is:

1. An electrostatic image developer, comprising:

a carrier including a core particle and having a plurality of projections and recesses on a surface of the carrier; and electrostatic image developing toners having a volume average particle diameter of from 2 μm to less than 4 μm, wherein the electrostatic image developer satisfies formulae (1) and (2):

$$0.5t<H \quad (1)$$

$$2^{1/2}t<L<5t \quad (2)$$

wherein t represents the volume average particle diameter (μm) of the toners;

H represents an average height difference (μm) in the recesses and projections of the carrier; and L represents an average distance (μm) between the projections.

2. The electrostatic image developer according to claim 1, wherein the projections contain a conductive material.

3. The electrostatic image developer according to claim 1, wherein the average height difference in the recesses and projections of the carrier H is from 1.5 to 3.5 μm.

4. The electrostatic image developer according to claim 1, wherein the average distance between the projections L is from 5.0 to 15.0 μm.

5. The electrostatic image developer according to claim 1, wherein the carrier has a shape factor SF1 of from more than 145 to 170.

6. The electrostatic image developer according to claim 1, wherein the number of toners adhered to the projections is smaller than the number of toners adhered to the surface of the core particle.

7. The electrostatic image developer according to claim 1, which comprises a plurality of carriers, wherein a volume average particle diameter $D_{50v}$ of the carriers is from 15 to 50 μm.

8. The electrostatic image developer according to claim 1, wherein the carrier has a magnetic susceptibility σ of from 50 to 90 $Am^2/kg$ (emu/g).

9. The electrostatic image developer according to claim 1, wherein the carrier has a dynamic electric resistance of from 1×10 to $1\times10^9$ Ω·cm under an electric field of $10^4$ V/cm.

10. The electrostatic image developer according to claim 1, wherein a volume average grain size distribution index GSDv of the electrostatic image developing toners is from 1.1 to 1.4.

11. The electrostatic image developer according to claim 1, wherein a toner shape factor SF1 of the electrostatic image developing toners is from 110 to 140.

12. The electrostatic image developer according to claim 1, wherein the carrier is produced by a method including:

preparing a carrier core particle;

preparing a plurality of particles that form projections;

mixing a dispersion of the carrier core particle and a dispersion of the plurality of particles that form projections to form a particle in which the plurality of particles that form projections are adhered to a surface of a single carrier core particle; and heating the carrier core particle and the plurality of particles which form projections adhered to the surface of the core particle to fuse those particles.

13. An image forming method, comprising:

charging an image holder;

forming an electrostatic latent image on a surface of the image holder;

developing the electrostatic latent image formed on the surface of the image holder with a developer to form a toner image; and transferring the toner image to a material to be transferred, wherein the developer is the electrostatic image developer according to claim 1.

* * * * *